US011852093B2

(12) United States Patent
Aono et al.

(10) Patent No.: US 11,852,093 B2
(45) Date of Patent: Dec. 26, 2023

(54) CONTROL DEVICE FOR HIGH-PRESSURE FUEL PUMP

(71) Applicant: Hitachi Astemo, Ltd., Hitachinaka (JP)

(72) Inventors: Toshihiro Aono, Tokyo (JP); Osamu Mukaihara, Hitachinaka (JP); Kenichiro Tokuo, Hitachinaka (JP); Hirotaka Nakai, Hitachinaka (JP); Kotaro Oki, Hitachinaka (JP); Shunsuke Aritomi, Tokyo (JP); Akiyasu Miyamoto, Tokyo (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 17/790,367

(22) PCT Filed: Dec. 25, 2020

(86) PCT No.: PCT/JP2020/048695
§ 371 (c)(1),
(2) Date: Jun. 30, 2022

(87) PCT Pub. No.: WO2021/171775
PCT Pub. Date: Sep. 2, 2021

(65) Prior Publication Data

US 2023/0038318 A1 Feb. 9, 2023

(30) Foreign Application Priority Data

Feb. 28, 2020 (JP) ..... 2020-033341

(51) Int. Cl.
*F02D 41/20* (2006.01)
*F02D 41/14* (2006.01)
*F02M 59/36* (2006.01)

(52) U.S. Cl.
CPC ..... *F02D 41/20* (2013.01); *F02D 41/1401* (2013.01); *F02M 59/368* (2013.01);
(Continued)

(58) Field of Classification Search
CPC .. F02D 41/1401; F02D 41/20; F02D 41/3845; F02D 43/02; F02D 2041/1432;
(Continued)

(56) References Cited

U.S. PATENT DOCUMENTS 11,359,567 B2 * 6/2022 Miyamoto ..... F02D 41/04
2009/0301439 A1 12/2009 Suzuki et al.
(Continued)

FOREIGN PATENT DOCUMENTS

JP 2010-14109 A 1/2010
JP 2012-246852 A 12/2012
(Continued)

OTHER PUBLICATIONS

International Search Report (PCT/ISA/210) issued in PCT Application No. PCT/JP2020/048695 dated Apr. 20, 2021 with English translation (four (4) pages).
(Continued)

*Primary Examiner* — Hung Q Nguyen
*Assistant Examiner* — Mark L. Greene
(74) *Attorney, Agent, or Firm* — Crowell & Moring LLP

(57) ABSTRACT

Low noise control of a high-pressure fuel pump is performed by reducing noise generated by an anchor colliding with a fixing core. A control device 800 for a high-pressure fuel pump controls a suction valve that opens and closes an inflow port through which fuel flows to a pressurizing chamber by performing energization to a solenoid 205 in synchronization with a reciprocating motion of a plunger. A current energized to the solenoid 205 includes a peak current for giving a force to start closing a valve to the suction valve in a stationary state and a holding current for performing switching in a range smaller a maximum value of the peak current in order to hold the suction valve in a valve closing state. When the control device 800 reduces a peak current
(Continued)

application amount of the peak current from a value sufficient to close the high-pressure fuel pump, a valve closing speed of the suction valve becomes small up to a certain application amount, and when the peak current application amount becomes smaller than the application amount, there is a saturation range of a current application amount of the peak current in which the valve closing speed of the suction valve is saturated. The control device 800 controls the current application amount of the peak current to fall in the saturation range.

3 Claims, 16 Drawing Sheets

(52) U.S. Cl.
CPC ..... *F02D 2041/1432* (2013.01); *F02D 2041/2034* (2013.01); *F02D 2041/2037* (2013.01); *F02D 2041/2055* (2013.01); *F02D 2041/2058* (2013.01)

(58) Field of Classification Search
CPC ..... F02D 2041/2034; F02D 2041/2037; F02D 2041/2055; F02D 2041/2058; F02M 59/36; F02M 59/366; F02M 59/368
See application file for complete search history.

(56) References Cited

U.S. PATENT DOCUMENTS

| | | | |
|---|---|---|---|
| 2011/0315124 | A1 | 12/2011 | Richter et al. |
| 2017/0082099 | A1 | 3/2017 | Takagawa et al. |

FOREIGN PATENT DOCUMENTS

| | | | | |
|---|---|---|---|---|
| JP | 2015-218656 | A | 12/2015 | |
| JP | 2017-75609 | A | 4/2017 | |
| KR | 101510320 | B1 * | 4/2015 | ..... F02M 63/0015 |

OTHER PUBLICATIONS

Japanese-language Written Opinion (PCT/ISA/237) issued in PCT Application No. PCT/JP2020/048695 dated Apr. 20, 2021 (five (5) pages).

* cited by examiner

CHANGE IN SWITCHING FREQUENCY
DUE TO VALVE CLOSING

CURRENT
TIME
S1601
DIFFERENTIATING

TIME
S1602
ABSOLUTE VALUE

TIME
S1603
SMOOTHING

TIME
DETECT AS VALVE-CLOSING-
COMPLETION TIMING Tb

CONTROL DEVICE FOR HIGH-PRESSURE FUEL PUMP

TECHNICAL FIELD

The present invention relates to a control device for a high-pressure fuel pump.

BACKGROUND ART

An internal combustion engine of an automobile is required to have high efficiency, low exhaust, and high output. As means for solving these requirements in a well-balanced manner, direct injection internal combustion engines have been widely used for a long time. Automobile manufacturers and suppliers have constantly made efforts to improve product values, and one of important problems is to achieve low noise of a high-pressure fuel pump. In order to achieve the low noise of the high-pressure fuel pump, a drive current of the high-pressure fuel pump may be reduced, but when the drive current is excessively reduced, the high-pressure fuel pump cannot discharge fuel. An optimum current application amount for achieving low noise varies depending on the individual of the high-pressure fuel pump. In the low noise control of the pump of the related art, a technique disclosed in the following PTL 1 has been used in order to examine a minimum current application amount for each individual pump within a range in which the discharge of the fuel does not fail.

As an example of the low noise control of the pump of the related art, claim 1 of PTL 1 discloses an invention of "a control device for a high pressure pump comprising motion detection means for detecting a motion of a valve body with respect to a drive command of a control valve when an electromagnetic portion is energized by the drive command to displace the valve body to a target position, and energization control means for performing power reduction control of reducing, by a predetermined amount, a supply power to be supplied to the electromagnetic portion at the time of subsequent energization later than a time of previous energization, when the motion detection unit detects that the valve body is displaced to the target position at the time of the previous energization".

Claim 2 of PTL 1 discloses an invention that "the control device for a high pressure pump according to claim 1, wherein the energization control means performs power increase control to increase, by a predetermined amount, the supply power to be supplied to the electromagnetic portion at the time of the subsequent energization from the supply power at the time of the previous energization when the motion detection unit does not detect that the valve body is displaced to the target position at the time of the previous energization".

CITATION LIST

Patent Literature

PTL 1: JP 2017-75609 A

SUMMARY OF INVENTION

Technical Problem

Incidentally, a normally opened high-pressure fuel pump, an anchor collides with a fixing core before a suction valve constituting the high-pressure fuel pump is closed. When an excessive current is energized to the solenoid in order to successfully close the valve in all the high-pressure fuel pumps regardless of individual differences of the high-pressure fuel pumps, since a speed at which the anchor moves toward the fixing core increases, a large noise is generated when the anchor collides with the fixing core. On the other hand, in order to reduce this noise, when a method of the related art in which the control device repeatedly increases or decreases the current application amount near a minimum current application amount that can be closed to search for a minimum value of the current application amount is used, valve closing failure occurs at a constant frequency.

The present invention has been made in view of such a situation, and an object thereof is to perform low noise control of a high-pressure fuel pump without causing valve closing failure.

Solution to Problem

A control device for a high-pressure fuel pump according to the present invention controls a suction valve that opens and closes an inflow port through which fuel flows into a pressurizing chamber by performing energization to a solenoid in synchronization with a reciprocating motion of a plunger. A current energized to the solenoid includes a peak current for giving a force to start closing a valve to the suction valve in a stationary state and a holding current for performing switching in a range smaller a maximum value of the peak current in order to hold the suction valve in a valve closing state. When control device reduces a peak current application amount of the peak current from a value sufficient to close the high-pressure fuel pump, a valve closing speed of the suction valve becomes small up to a certain application amount, and when the peak current application amount becomes smaller than the application amount, there is a saturation range of a current application amount of the peak current in which the valve closing speed of the suction valve is saturated. The control device controls the current application amount of the peak current to fall in the saturation range.

Advantageous Effects of Invention

According to the present invention, it is possible to control the current energized to the solenoid in the region where the noise can be most reduced without using the method of the related art for searching for the most appropriate current application amount for achieving low noise by repeating the valve closing success and the valve closing failure.

Other objects, configurations, and effects will be made apparent in the following descriptions.

DESCRIPTION OF EMBODIMENTS

Figure 1:
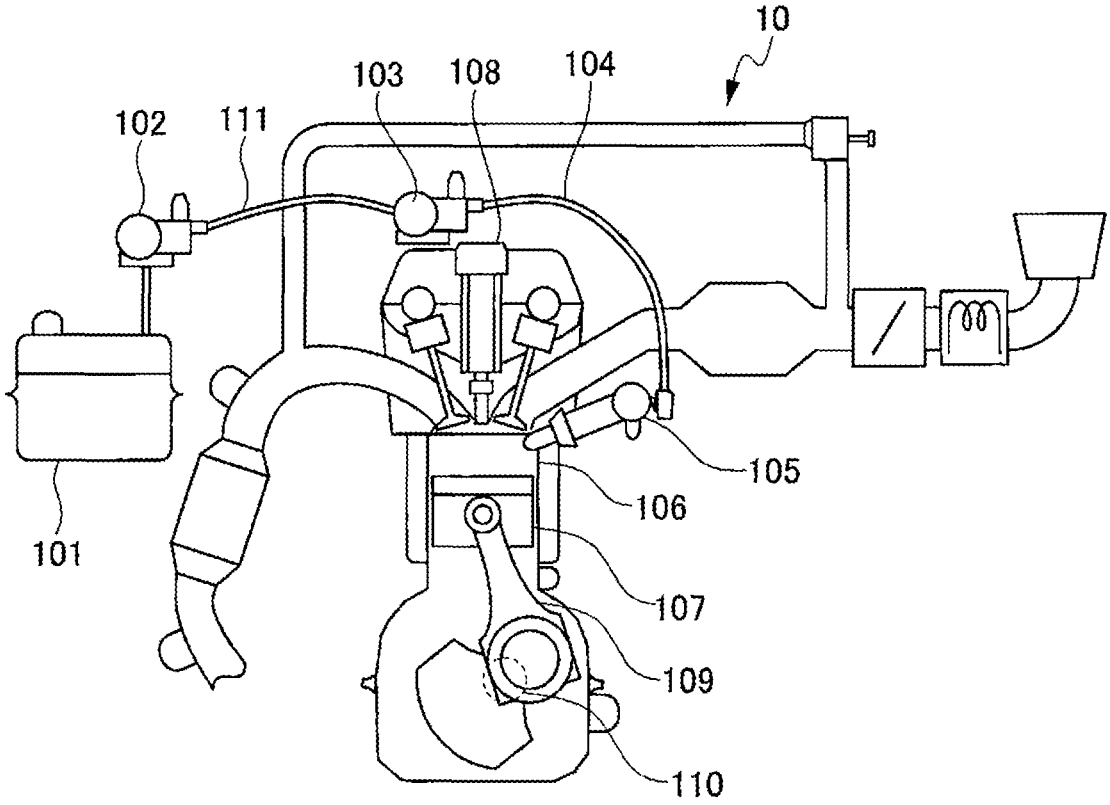
FIG. 1 is a diagram illustrating a schematic configuration of a direct injection internal combustion engine common to embodiments of the present invention.

Hereinafter, embodiments for carrying out the present invention will be described with reference to the accompanying drawings, but the present embodiments are not limited to the embodiments described in the drawings. In the present specification and drawings, components having substantially the same function or configuration are denoted by the same reference signs, and thus, the redundant description will be omitted.

A control device according to each embodiment to be described below is applied to control of a normally opened high-pressure fuel pump. In the normally opened high-pressure fuel pump, a valve body (suction valve) is opened when a current does not flow in a solenoid, and the valve body is closed when the current flows in the solenoid. In the normally opened high-pressure fuel pump, the valve body is closed to prevent fuel compressed by the rising of a plunger from returning to a low pressure pipe side, and the fuel is discharged to a high pressure pipe side. However, when the valve closing and the valve opening are replaced, a control device according to a first embodiment can also be applied to control of a normally closed high-pressure fuel pump.

Before describing a control device according to first to third embodiments to which the present invention is applied, examples of configurations and operations of a high-pressure fuel pump and a control device common to the embodiments will be described with reference to FIGS. 1 to 7.

<<Outline of Internal Combustion Engine>>

FIG. 1 is a diagram illustrating a schematic configuration of a direct injection internal combustion engine 10.

In the direct injection internal combustion engine 10, fuel stored in a fuel tank 101 is pressurized to about 0.4 MPa by a feed pump 102, and flows into a high-pressure fuel pump 103 via a low pressure pipe 111. The fuel is further pressurized to several tens of MPa by the high-pressure fuel pump 103. The pressurized fuel is injected from a direct injection injector 105 to a cylinder 106 of the direct injection internal combustion engine 10 via a high pressure pipe 104.

The injected fuel is mixed with air sucked into the cylinder 106 by an operation of a piston 107. The air-fuel mixture is ignited by a spark generated by an ignition plug 108 and explodes. The air-fuel mixture in the cylinder 106 expands by heat generated by the explosion, and pushes down the piston 107. A force pushing down the piston 107 rotates a crankshaft 110 via a link mechanism 109. The rotation of the crankshaft 110 is transmitted to wheels through a transmission and becomes a force for moving a vehicle.

Generally, an internal combustion engine is mainly required to have low fuel consumption, high output, and exhaust gas purification, but noise and vibration are required to be reduced as further added values. In the high-pressure fuel pump 103, when a suction valve that sucks fuel is opened and closed, a valve body or an anchor collides with a stopper, and thus, noise is generated. Automobile manufacturers and suppliers make a lot of efforts to reduce noise. Hereinafter, a structure example of the high-pressure fuel pump 103 to be controlled by the control device according to the present embodiment will be described.

<<Configuration of High-Pressure Fuel Pump>>

Figure 2:
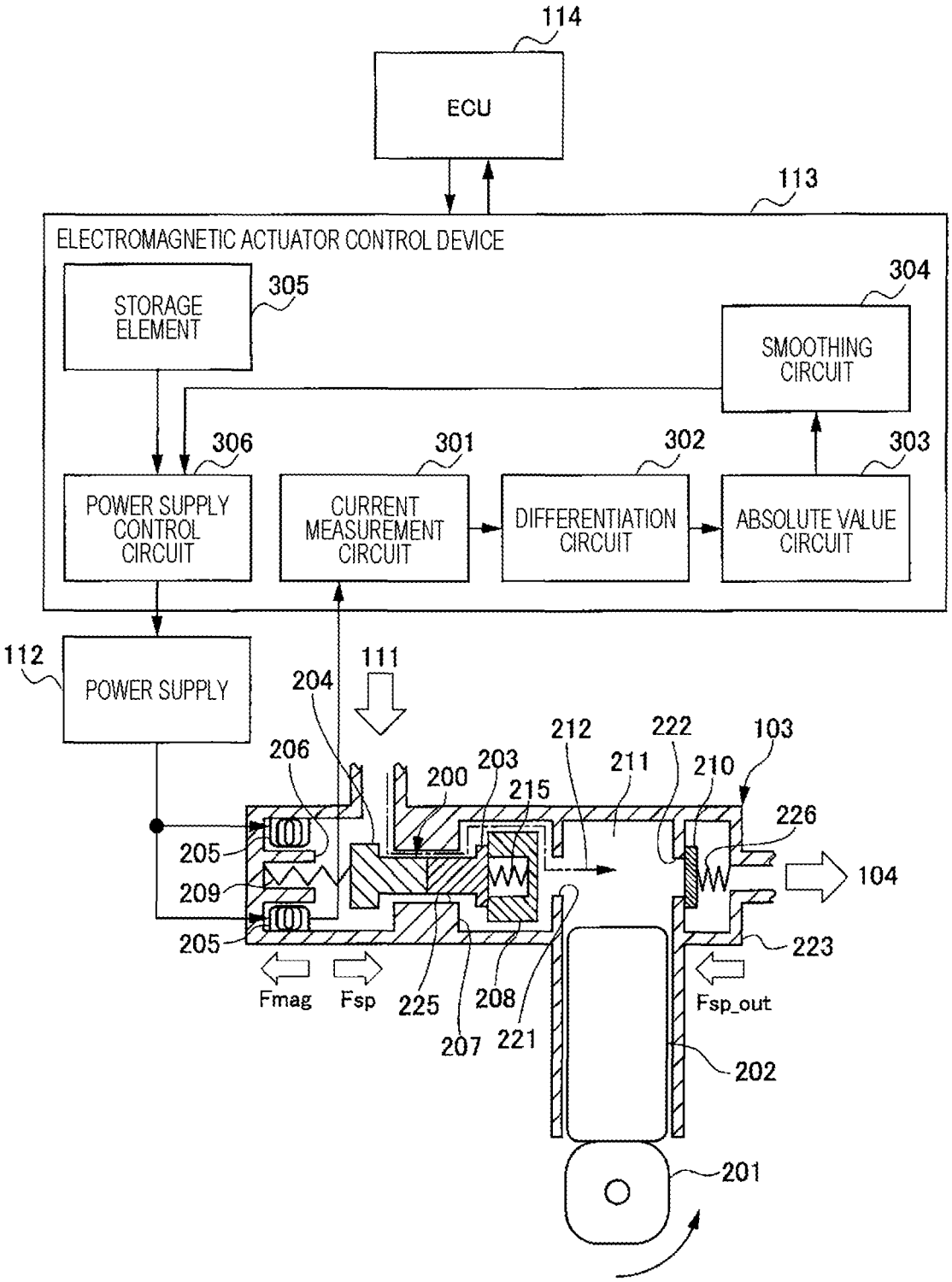
FIG. 2 is a diagram illustrating a structure example of a high-pressure fuel pump common to the embodiments of the present invention.

FIG. 2 is a diagram illustrating the structure example of the high-pressure fuel pump 103.

The high-pressure fuel pump 103 illustrated in FIG. 2 is referred to as a normally opened high-pressure fuel pump, and the normally opened high-pressure fuel pump will be described in the present embodiment. However, the high-pressure fuel pump can also be applied to a normally closed high-pressure fuel pump when the valve closing and the valve opening are replaced.

A plunger 202 included in the high-pressure fuel pump 103 moves up and down by rotation of a cam 201 attached to a camshaft of the direct injection internal combustion engine 10. An anchor 204 is attracted to a fixing portion 206 in synchronization with a vertical movement of the plunger 202, and thus, a suction valve 203 opens and closes an inflow port 225. A solenoid 205 that generates an electromagnetic force by energizing a current I controls an opening and closing operation of the suction valve 203. The anchor 204 is attracted to a fixing core (fixing portion 206) by the electromagnetic force generated by the solenoid 205, and controls the operation of the suction valve 203.

The high-pressure fuel pump 103 is surrounded by a casing 223, and a pressurizing chamber 211 is disposed therein. The pressurizing chamber 211 is a region in a range divided by a communication port 221 and an outflow port 222. From the low pressure pipe 111 side, the fuel flows into the pressurizing chamber 211 through the inflow port 225 and the communication port 221. The fuel flowing into the pressurizing chamber 211 is discharged to the high pressure pipe 104 side through the outflow port 222.

The outflow port 222 is opened and closed by a discharge valve 210. The discharge valve 210 is constantly biased by a spring portion 226 in a direction of closing the outflow port 222, and when a pressure of the pressurizing chamber 211 exceeds a spring force of the spring portion 226, the outflow port 222 is opened, and the fuel is injected.

In the high-pressure fuel pump 103, an operation of the anchor 204 in an axial direction (left-right direction in FIG. 2) is controlled by controlling ON or OFF of the energization of the solenoid 205. In a state where the energization of the solenoid 205 is OFF, the anchor 204 is constantly biased in a valve opening direction (a right direction in FIG. 2) by a first spring 209, and the suction valve 203 pressed by the anchor 204 comes into contact with a stopper 208 to be in a stationary state. Thus, the suction valve 203 is maintained at a valve opening position. FIG. 2 illustrates a scene of the suction valve 203 in a valve opening state. A dashed dotted line 212 illustrated in the drawing indicates an inflow direction of the fuel from the low pressure pipe 111 to the pressurizing chamber 211.

When the energization of the solenoid 205 is turned on, a magnetic attraction force Fmag is generated between the fixing portion 206 (magnetic core) and the anchor 204. Due to the magnetic attraction force Fmag, the anchor 204 provided on a proximal end (root portion of the first spring 209) side of the suction valve 203 is attracted in a valve closing direction (left direction in FIG. 2) against a spring force Fsp of the first spring 209, and the anchor 204 is accelerated.

In a state where the anchor 204 is attracted to the fixing portion 206, the suction valve 203 is a check valve that is opened and closed based on a differential pressure between an upstream side and a downstream side and a biasing force of a second spring 215. Thus, as a pressure on the downstream side of the suction valve 203 increases, the suction valve 203 moves in the valve closing direction. When the suction valve 203 moves by a lift amount set in the valve closing direction, since a projection of the suction valve 203 is seated on a seat portion 207 and the suction valve 203 is closed, the fuel in the pressurizing chamber 211 cannot flow back to the low pressure pipe 111 side. Accordingly, the fuel compressed by the rising of the plunger 202 is discharged to the high pressure pipe through the outflow port 222.

Operations (mainly, the energization to the solenoid 205 and the movement of the anchor 204) of the high-pressure fuel pump 103 are controlled by an electromagnetic actuator control device 113. The electromagnetic actuator control device 113 is an example of the control device according to the present invention. The operations of the electromagnetic actuator control device 113 are controlled by a drive pulse output from an internal combustion engine control device (hereinafter, an engine control unit (ECU)) 114 that controls the entire operation of the direct injection internal combustion engine 10. Operation information from the electromagnetic actuator control device 113 and operation information of the high-pressure fuel pump 103 (rotation angle of the camshaft detected by a camshaft sensor, and the like) are input to the ECU 114.

The electromagnetic actuator control device 113 includes a current measurement circuit 301 that measures the current I energized to the solenoid 205 and converts the current I into a voltage, a differentiation circuit 302 that differentiates the voltage converted by the current measurement circuit 301, an absolute value circuit 303 that obtains an absolute value of the differentiated voltage, a smoothing circuit 304 that smooths an output of the absolute value circuit 303, a storage element 305 that stores a value (for example, a maximum value of a peak current Ia) used for controlling the high-pressure fuel pump 103, and a power supply control circuit 306 that controls an operation of the power supply 112 that controls the solenoid 205. A detailed operation of each unit of the electromagnetic actuator control device 113 will be described later with reference to FIG. 15 and subsequent drawings.

<<Time Chart of High-Pressure Fuel Pump Operation>>

Figure 3:
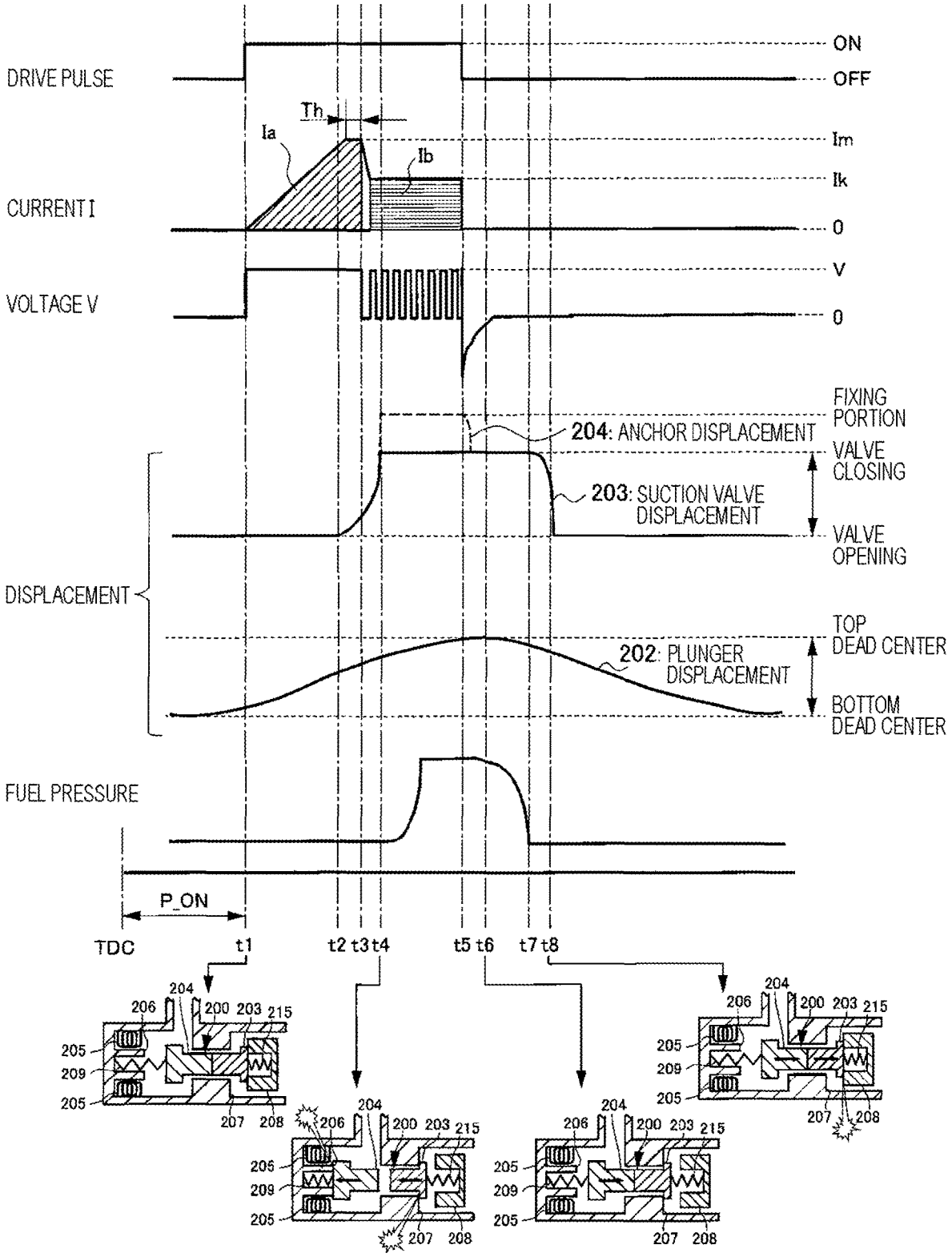
FIG. 3 is a time chart for describing an operation of the high-pressure fuel pump common to the embodiments of the present invention.

FIG. 3 is a time chart for describing the operation of the high-pressure fuel pump 103. On a lower side of the time chart, a scene of the operation of the high-pressure fuel pump 103 at timings t1, t4, t6, and t8 is illustrated.

As illustrated in an uppermost stage of FIG. 3, the ECU 114 illustrated in FIG. 2 controls a flow rate of the fuel discharged from the high-pressure fuel pump 103 by changing a timing of turning on the drive pulse output to the electromagnetic actuator control device 113 (pump drive driver). For example, the ECU 114 detects the rotation angle of the camshaft in order to set a reference for opening and closing the suction valve 203 in synchronization with the vertical movement (plunger displacement) of the plunger 202. The ECU 114 outputs an ON drive pulse to the electromagnetic actuator control device 113 after the cam 201 rotates at an angle (P_ON timing illustrated in the lower left of FIG. 3) determined from, for example, a top dead center (TDC).

The power supply control circuit 306 of the electromagnetic actuator control device 113 controls the power supply 112 such that the power supply 112 starts to apply a voltage V indicated by a voltage waveform of FIG. 3 to both ends of the solenoid 205 when the drive pulse input from the ECU 114 is ON (timing t1). At timing t1, the anchor 204 is pressed against the suction valve 203 by a biasing force of the first spring 209.

The current I energized to the solenoid 205 is increased by the voltage V according to the following Equation (1).

$$LdI/dt=V-RI \quad (1)$$

In Equation (1), L indicates an inductance of the solenoid 205, and R indicates a resistance of a wiring. As the current I increases, the magnetic attraction force Fmag by which the fixing portion 206 attracts the anchor 204 also increases.

When the magnetic attraction force Fmag becomes larger than the spring force Fsp of the first spring 209, the anchor 204 pressed by the spring force Fsp starts to move toward the fixing portion 206 (timing t2). When the anchor 204 moves, the suction valve 203 is also moved toward the fixing portion 206 following the anchor 204 by being pressed by the fuel pressurized by the rising of the plunger 202.

As illustrated in the graph of the current I in FIG. 3, the current I energized to the solenoid 205 includes a peak current Ia that gives a force to start closing the suction valve 203 in the stationary state and a holding current Ib that performs switching in a range lower than a maximum value of the peak current Ia in order to hold the suction valve 203 in the valve closing state. Since the anchor 204 and the suction valve 203 move by inertia, the electromagnetic actuator control device 113 controls the power supply 112 to cut off the peak current Ia before the closing of the suction valve 203 is completed (timing t3). In the following description, "valve closing completion" means a timing at which the projection of the suction valve 203 is seated on the seat portion 207 and the suction valve 203 is closed while the anchor 204 collides with the fixing portion 206. The peak current Ia indicated by a slanting line portion in a current waveform in the drawing indicates a current energized to the solenoid 205 in order to give a closing force to the suction valve 203 and the anchor 204 pressed by the first spring 209 and stopped at the valve opening position.

After timing t3, the holding current Ib is energized to the solenoid 205. The holding current Ib indicated by a horizontal line portion in the current waveform in the drawing indicates a current energized to the solenoid 205 by switching the voltage in order to attract the anchor 204 approaching the fixing portion 206 until colliding with the fixing portion 206 and maintain the contact state after the collision. By switching the voltage, this current oscillates in a certain range. Here, a maximum current value of the peak current Ia is "Im", and a maximum current value of the holding current Ib is "Ik".

Eventually, the protrusion provided at the distal end of the suction valve 203 collides with the seat portion 207, and the suction valve 203 is seated. A flow path of the fuel indicated by the dashed dotted line 212 in FIG. 2 is blocked by this collision (timing t4). Since the fuel pressurized by the rising of the plunger 202 cannot return to the low pressure pipe 111 side, the pressure of the pressurizing chamber 211 increases. Since the anchor 204 continues to move even after the suction valve 203 collides with the seat portion 207, the displacement of the anchor 204 indicated by a broken line in the time chart becomes larger than the displacement of the suction valve 203.

When the pressure of the pressurizing chamber 211 becomes larger than a spring force Fsp out (see FIG. 2) of the spring portion 226 that presses the discharge valve 210, the discharge valve 210 is opened, and the fuel pressurized by the rising of the plunger 202 is discharged to the high pressure pipe 104. Thereafter, when the drive pulse input from the ECU 114 is OFF, a reverse voltage is applied to the solenoid 205 (timing t5). When the reverse voltage is applied, the holding current Ib supplied to the solenoid 205 is cut off. Thus, the anchor 204 starts to move in the right direction in FIG. 2 by being pressed by the force of the first spring 209 larger than the magnetic attraction force.

As illustrated in a fifth stage from the top in FIG. 3, when a cam angle exceeds the top dead center and the plunger 202 starts to descend (timing t6), a fuel pressure of the pressurizing chamber 211 starts to decrease as illustrated in a sixth stage from the top in FIG. 3. When the fuel pressure becomes smaller than the spring force Fsp out of the spring portion 226, the discharge valve 210 is closed and the discharging of the fuel is ended (timing t7).

The anchor 204 moves from the valve closing position to the valve opening position together with the suction valve 203 due to the decrease in the fuel pressure of the pressurizing chamber 211 (timings t7 to t8).

By such an operation, the high-pressure fuel pump 103 sends the fuel from the low pressure pipe 111 to the high pressure pipe 104. In this process, noise is generated when the anchor 204 collides with the fixing portion 206 after the valve closing is completed (timing t4) and when the suction valve 203 and the anchor 204 collide with the stopper 208 and the valve opening is completed (timing t8). In particular, noise generated when the anchor 204 collides with the fixing portion 206 is large. This noise may make drivers feel uncomfortable particularly when idling, and automobile manufacturers and suppliers of high-pressure fuel pumps are overcoming this noise reduction. Thus, the electromagnetic actuator control device 113 according to the present embodiment has been invented particularly for the purpose of reducing noise generated when the valve closing is completed.

<<Peak Current Ia and Holding Current Ib>>

Here, the current energized to the solenoid 205 in order for the electromagnetic actuator control device 113 to drive the high-pressure fuel pump 103 will be described.

As described above, the current for driving the high-pressure fuel pump 103 roughly includes the peak current Ia and the holding current Ib. When the peak current Ia is integrated in a period from timings t1 to t3 illustrated in FIG. 3, a peak current integral value II is calculated. The peak current integral value II is defined by an integral value of the current I energized to the solenoid 205 from timing t1 at which the supply of the peak current Ia is started to timing t3 at which the reduction of the peak current Ia is started illustrated in FIG. 3.

Since the peak current Ia is energized to the solenoid 205 in order to give the closing force to the suction valve 203 and the anchor 204, when the peak current integral value II is reduced, a force to close the valve is weakened, and noise can be reduced. However, when the peak current integral value II is excessively reduced, the valve closing fails. Thus, there has been a demand for reducing the peak current integral value II as much as possible within a range in which the suction valve 203 is closed.

<<Individual Difference of Peak Current to be Applied>>

Figure 4:
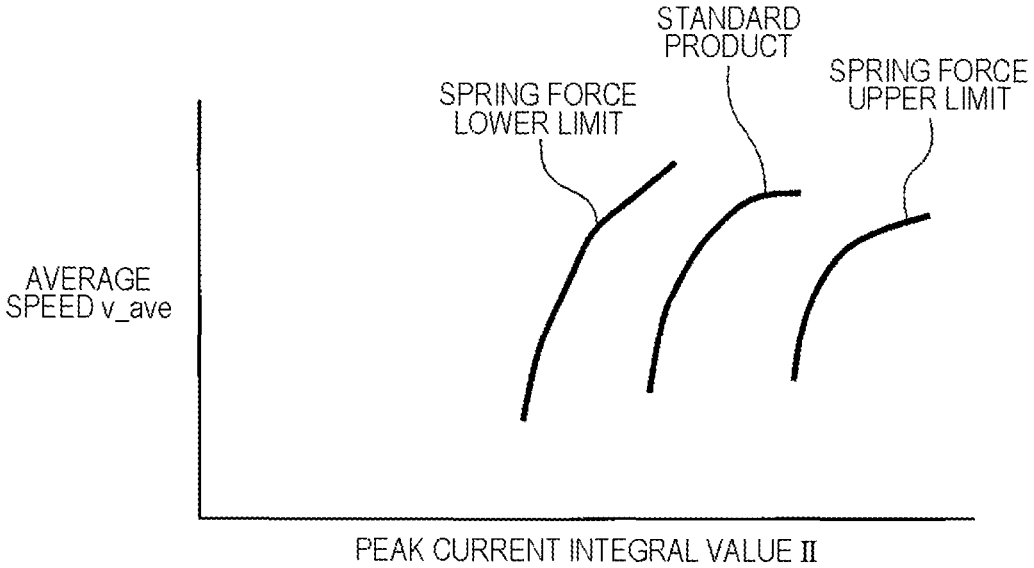
FIG. 4 is a diagram illustrating variations in individual characteristics of the high-pressure fuel pump common to the embodiments of the present invention.

Incidentally, there is a problem that the peak current integral value II at a limit at which the suction valve 203 is closed depends on individual characteristics of the high-pressure fuel pump 103. Here, a change in a minimum peak current integral value II depending on an individual difference (spring force Fsp) of the first spring 209 that is dominant among individual differences in order to close the valve will be described with reference to FIG. 4. In FIG. 4, a horizontal axis indicates the peak current integral value II, and a vertical axis indicates an average speed v_ave of the suction valve 203.

FIG. 4 illustrates a relationship between the average speed v_ave (average value of speeds from the start of closing the valve to the completion of closing the valve) when the suction valve 203 is closed and the peak current integral value II for a product of which the spring force Fsp is standard (denoted as "standard product" in the drawing), an upper limit having an upper limit in manufacturing variation (denoted as a "spring force upper limit" in the drawing), and a lower limit having a lower limit (denoted as a "spring force lower limit" in the drawing).

In the present embodiment, the peak current integral value II used as a current application amount is calculated as an integral value integrated in a predetermined period from the start of energization of the peak current Ia. However, the current application amount may be defined by any one of an integral value of the square of the peak current Ia integrated in the predetermined period from the start of energization of the peak current Ia or an integral value of a product of the current I energized to the solenoid 205 and the voltage V applied to the solenoid 205.

It can be seen from FIG. 4 that the relationship between the peak current integral value II and the average speed v_ave varies depending on the spring force Fsp. For example, when a minimum current for closing the lower limit product of the spring force Fsp is given to the upper limit product of the spring force Fsp, the magnetic attraction force Fmag generated by the solenoid 205 falls below the spring force Fsp, and the valve closing fails. Conversely, when the minimum current for closing the upper limit product of the spring force Fsp is given to the lower limit product of the spring force Fsp, an excessive magnetic attraction force Fmag is generated as compared with the spring force Fsp. Thus, the anchor 204 collides with the fixing portion 206 at a speed higher than necessary for closing the valve, the suction valve 203 is closed, and a noise level is maximized.

<<Dead Zone of Peak Current Integral Value II and Valve-Closing-Completion-Immediately-Preceding Speed vel_Tb>>

Thus, a method for controlling the valve closing of the suction valve 203 near a valve closing limit by repeating control for gradually reducing the peak current integral value II when the valve closing succeeds and increasing the peak current integral value II when the valve closing fails is considered. However, in this method, valve closing failure occurs at a certain frequency.

Figure 5:
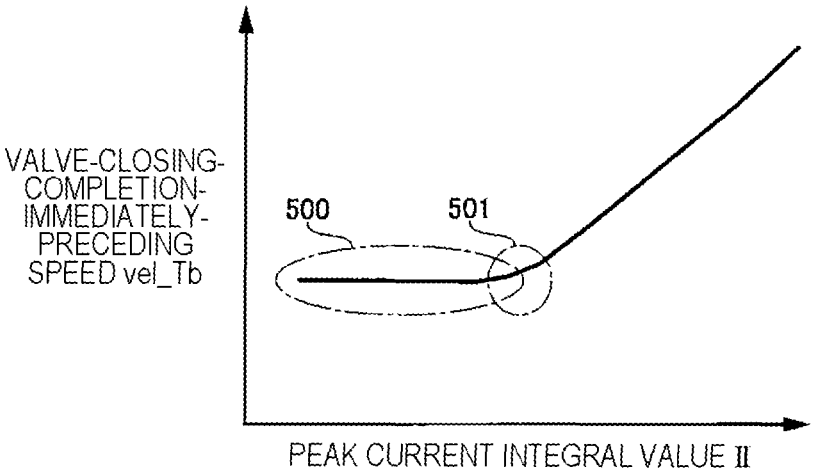
FIG. 5 is a diagram illustrating a scene in which a valve-closing-completion-immediately-preceding speed is saturated with respect to a peak current integral value of the high-pressure fuel pump common to the embodiments of the present invention.

In order to avoid such valve closing failure, the present inventors have examined the characteristics of the high-pressure fuel pump 103, and have found that there is a dead zone 500 illustrated in FIG. 5 in the relationship between the peak current integral value II and the valve-closing-completion-immediately-preceding speed vel_Tb. The reason why there is the dead zone 500 will be described with reference to FIGS. 5 and 6.

FIG. 5 is a diagram illustrating a scene in which the valve-closing-completion-immediately-preceding speed vel_Tb of the anchor 204 is saturated with respect to the peak current integral value II of the high-pressure fuel pump 103. In FIG. 5, a horizontal axis indicates the peak current integral value II, and a vertical axis indicates the valve-closing-completion-immediately-preceding speed vel_Tb.

FIG. 5 illustrates a tendency that the valve-closing-completion-immediately-preceding speed vel_Tb becomes small as the peak current integral value II becomes small (region where II is larger than a current application amount limit value 501) as predicted so far. However, when the peak current integral value II becomes smaller than the current application amount limit value 501, there is a region (dead zone 500) in which the decrease in the valve-closing-completion-immediately-preceding speed vel_Tb is saturated. In the dead zone 500, even though the peak current integral value II decreases, the valve-closing-completion-immediately-preceding speed vel_Tb does not become small. A case where a speed of the anchor 204 does not change and a valve closing speed of the suction valve 203 (a force in the valve closing) does not change even though the peak current Ia energized to the solenoid 205 increases or decreases in this manner is referred to as "saturation".

Thus, the current application amount and the force of closing the valve have a relationship in which the current application amount is reduced and the valve closing speed becomes slow when the current application amount is larger than a value sufficient to close the suction valve 203 and the valve closing speed is constant when the current application amount is equal to or less than a predetermined value.

As described above, when the peak current integral value II is larger than the current application amount limit value 501, the valve-closing-completion-immediately-preceding speed vel_Tb is also reduced along with the reduction of the peak current integral value II. However, in a region smaller than the current application amount limit value 501, the valve-closing-completion-immediately-preceding speed vel_Tb does not decrease and is maintained at a constant value even though the peak current integral value II is reduced. That is, there is the dead zone 500 in the peak current integral value II and the valve-closing-completion-immediately-preceding speed vel_Tb. The dead zone has a lower limit, and when the peak current integral value II is smaller than the lower limit, the valve closing fails due to the insufficient magnetic attraction force. Thus, a condition for minimizing the noise when the valve is closed is to control the peak current integral value II in this dead zone.

Figure 6:
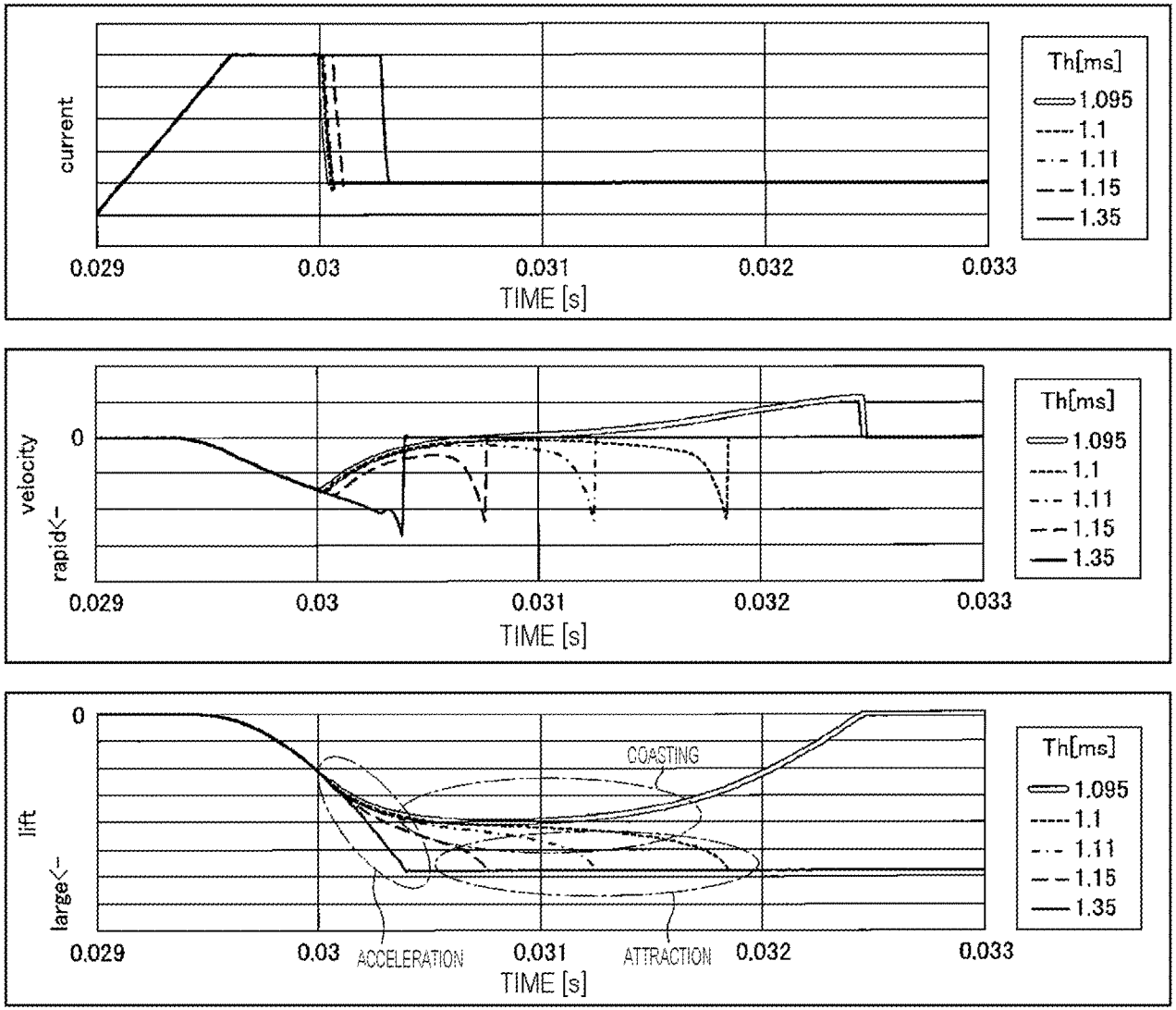
FIG. 6 is a diagram illustrating a speed of an anchor and valve closing displacement when a peak current common to the embodiments of the present invention changes.

Next, the reason why there is the dead zone 500 in FIG. 5 will be described with reference to FIG. 6. FIG. 6 is a diagram illustrating the valve closing speed and the valve closing displacement of the anchor 204 when the peak current Ia changes. An upper stage of FIG. 6 is a graph representing the current I energized to the solenoid 205, the middle stage of FIG. 6 is a graph representing the valve closing speed of the anchor 204, and the lower stage of FIG. 6 is a graph representing the valve closing displacement of the anchor 204. The speed and displacement in this drawing represent the valve opening direction as positive and the valve closing direction as negative. Five types of lines are drawn in the graphs at the upper, middle, and lower stages in FIG. 6. These lines represent the current I, the valve closing speed, and the valve closing displacement measured when a time width (peak current width Th) from when the maximum current value Im of the peak current Ia is supplied to the solenoid 205 to when the peak current Ia is cut off is set to 1.095 ms, 1.1 ms, 1.11 ms, 1.15 ms, and 1.35 ms.

From the relationship between the speed of the anchor 204 at the time of valve closing and the time illustrated in the middle stage of FIG. 6, it can be seen that the speed of the anchor 204 during valve closing is not constant. The noise level is dominated by the valve-closing-completion-immediately-preceding speed vel_Tb immediately before the anchor 204 collides with the fixing portion 206. When the peak current Ia is given to the solenoid 205 for a sufficiently long time (for example, in the case of a peak current width of 1.35 ms indicated by a solid line), the anchor 204 is constantly accelerated.

On the other hand, when the peak current width is shortened to 1.15 ms, 1.11 ms, 1.1 ms, or 1.095 ms, the anchor 204 starts to be decelerated from a timing (near 0.03 s to 0.0301 s) at which the electromagnetic actuator control device 113 cuts off the peak current Ia by the maximum current value Im. The anchor 204 coasts toward the fixing portion 206 at a low speed. For the peak current widths of 1.15 ms, 1.11 ms, and 1.1 ms, sections up to near 0.0306 s, 0.031 s, and 0.0316 s represent the coasting sections, respectively. When the peak current width is 1.095 ms, since the magnetic attraction force is insufficient, valve closing failure is caused from coasting.

When the anchor 204 approaches the fixing portion 206, the anchor 204 is accelerated again by the magnetic attraction force generated by the holding current Ib switched from the peak current Ia (for example, near 0.0306 s to 0.03075 s in the case of a peak current width of 1.15 ms indicated by a broken line). When the anchor 204 is re-accelerated by the magnetic attraction force Fmag by the holding current Ib from a state of substantially speed 0, the anchor 204 collides with the fixing portion 206 at a speed determined by a distance between the anchor 204 and the fixing portion 206 regardless of the method of the movement so far, and the suction valve 203 is closed. This is the reason why there is the dead zone 500 of the valve-closing-completion-immediately-preceding speed vel_Tb of the anchor 204 with respect to the peak current integral value II.

<<Dead Zone Between Valve-Closing-Completion Timing Tb and Valve-Closing-Completion-Immediately-Preceding Speed Vel_Tb>>

Since it has been found that there is the dead zone 500 in the relationship between the peak current integral value II and the valve-closing-completion-immediately-preceding speed vel_Tb, the horizontal axis of FIG. 5 is replaced with the valve-closing-completion timing Tb from the peak current integral value II. Although the valve-closing-completion timing Tb is a timing at which the suction valve 203 collides with the fixing portion 206, since a timing at which the anchor 204 collides with the fixing portion 206, which is slightly delayed, is more easily detected, this timing is referred to as the valve-closing-completion timing Tb for the sake of convenience.

Figure 7:
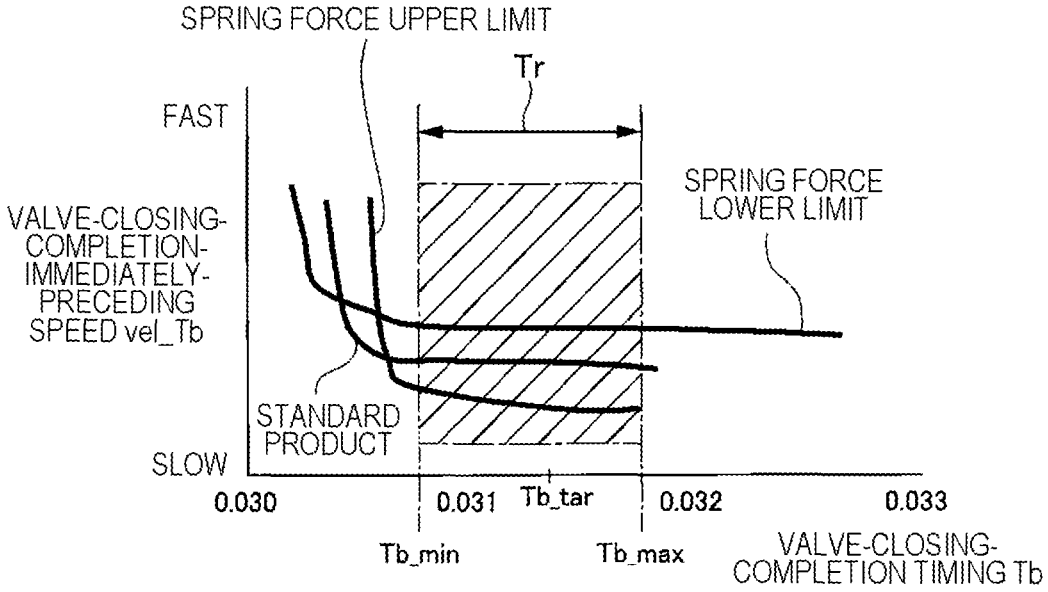
FIG. 7 is a diagram illustrating a relationship between a valve-closing-completion timing and the valve-closing-completion-immediately-preceding speed common to the embodiments of the present invention.

FIG. 7 is a diagram illustrating a relationship between the valve-closing-completion timing Tb and the valve-closing-completion-immediately-preceding speed vel_Tb.

As illustrated in FIG. 7, it can be seen that there is a dead zone in which the valve-closing-completion-immediately-preceding speed vel_Tb is constant regardless of the valve-closing-completion timing Tb between the valve-closing-completion timing Tb and the valve-closing-completion-immediately-preceding speed vel_Tb. For example, when the relationship between the valve-closing-completion timing Tb and the valve-closing-completion-immediately-preceding speed vel_Tb is plotted in a case where the spring force Fsp of the first spring 209 is the standard and the upper limit and the lower limit of the manufacturing variation, it can be seen that there is a saturation region Tr (a region indicated by a slanting line portion in the drawing) of the valve-closing-completion timing Tb in which vel_Tb of all the high-pressure fuel pumps 103 become a dead zone. In the saturation region Tr, the valve-closing-completion-immediately-preceding speed vel_Tb is substantially constant regardless of the valve-closing-completion timing Tb. As will be described later with reference to FIG. 10 and subsequent drawings, when a minimum value of the saturation region Tr is Tb min and a maximum value is Tb max, Tb_tar is set as a target value of the valve-closing-completion timing Tb in the saturation region Tr between Tb min and Tb max.

As described above, the present inventors have found that there is the saturation region Tr of the current I energized to the solenoid 205 in which the valve-closing-completion-immediately-preceding speed vel_Tb of the movable element (anchor 204) does not become small even though the current I flowing to the solenoid 205 is reduced. The fact that the valve-closing-completion-immediately-preceding speed vel_Tb of the movable element (anchor 204) is saturated means that the impact and noise at the time of valve closing, which are dominant by the valve-closing-completion-immediately-preceding speed, are saturated.

Referring back to FIG. 5, it can be seen that even though the current I flowing through the solenoid 205 is further reduced from the dead zone 500, there is a concern that the speed of the anchor 204 immediately before the valve closing completion cannot be further reduced and rather the valve closing fails. The dead zone 500 related to the current integral value II in FIG. 5 corresponds to the saturation region Tr of the valve-closing-completion timing Tb in FIG. 7.

Thus, in the control device according to the present embodiment, control is performed such that the valve-closing-completion timing Tb enters the saturation region Tr illustrated in FIG. 7, and thus, it is possible to realize the noise reduction of the electromagnetic actuator control device 113 while suppressing the valve closing failure. That is, the valve-closing-completion-immediately-preceding speed vel_Tb can be minimized by controlling the valve-closing-completion timing Tb within a set range of the saturation region Tr. Thus, the control device according to the present embodiment can minimize the impact or noise between the anchor 204 and the fixing portion 206 at the time of valve closing while suppressing the valve closing failure by setting the valve-closing-completion timing Tb within the range of the saturation region Tr (set range) and decelerating the anchor 204.

In the control device of the related art disclosed in PTL 1, since the increase and decrease of the current application amount are repeated near the minimum current application amount with which the valve can be closed, the valve closing failure occurs once in several strokes. The valve closing failure causes pulsation of the fuel pressure. The pulsation of the fuel pressure causes the variation in the amount of fuel injected from the injector. However, in the control device according to the present embodiment, the valve closing failure is suppressed by energizing the peak current Ia to the solenoid 205 so as to have an appropriate current amount. Thus, the fuel pulsation of the high pressure fuel pipe from the high-pressure fuel pump 103 to the injector 105 can be reduced. When the fuel pulsation is reduced, the variation in the amount of fuel injected from the injector 105 can be suppressed.

As described with reference to FIG. 4, since there is no peak current integral value II that can perform low noise control of all the high-pressure fuel pumps 103, it has been necessary to adjust the peak current integral value II according to the characteristics of the high-pressure fuel pump 103 in the related art. However, as described with reference to FIG. 7, the electromagnetic actuator control device 113 according to the present embodiment can achieve low noise of all the high-pressure fuel pumps 103 by performing control such that the valve-closing-completion timing Tb enters the saturation region Tr common to all the high-pressure fuel pumps 103.

The phenomenon found by the present inventors has been described above in the control of the high-pressure fuel pump 103 in which the electromagnetic actuator control device 113 applies the peak current Ia and the holding current Ib to the solenoid 205 and switches from the peak current Ia to the holding current Ib before the closing of the suction valve 203 is completed. In the phenomenon, as described above, when the peak current integral value II is decreased, the valve-closing-completion-immediately-preceding speed vel_Tb also becomes small, but even though the peak current integral value II is smaller than the current application amount limit value, the decrease of the valve-closing-completion-immediately-preceding speed vel_Tb stops and the valve-closing-completion-immediately-preceding speed vel_Tb is saturated. Hereinafter, the control device according to the first to third embodiments capable of achieving the low noise of the high-pressure fuel pump based on the phenomenon in which the valve-closing-completion-immediately-preceding speed vel_Tb is saturated will be described. The control device according to each embodiment corresponds to the electromagnetic actuator control device 113 illustrated in FIG. 2. In the control device according to the first to third embodiments to be described below, an operation of controlling the suction valve 203 that opens and closes the inflow port through which the fuel flows into the pressurizing chamber 211 by performing the energization to the solenoid 205 in synchronization with a reciprocating motion of the plunger 202 illustrated in FIG. 2 is common.

First Embodiment: Current Control in Dead Zone of Valve-Closing-Completion-Immediately-Preceding Speed vel_Tb with Respect to Peak Current Integral Value II A control device 800 (see FIG. 8) according to the first embodiment controls the high-pressure fuel pump 103 by the current I energized to the solenoid 205, that is, the peak current Ia that gives the force to start closing the suction valve 203 in the stationary state and the holding current Ib that performs switching in a current range lower than a maximum value of the peak current Ia in order to hold the suction valve 203 in the valve closing state. When the peak current application amount of the peak current Ia is reduced from a value sufficient to close the high-pressure fuel pump 103, the valve closing speed of the suction valve 203 becomes small up to a certain application amount, and there is a saturation range of the current application amount of the peak current Ia in which the valve closing speed of the suction valve 203 is saturated when the peak current application amount becomes smaller than the certain application amount. The control device 800 controls the current application amount of the peak current Ia so as to fall within this saturation range.

In other words, the control device 800 controls the force of closing the suction valve 203 by performing control such that the peak current integral value II falls within the range of the dead zone 500.

As described above, the control device 800 (see FIG. 8 to be described later, corresponding to the electromagnetic actuator control device 113 of FIG. 2) according to the first embodiment performs control such that the suction valve 203 is maintained in the valve closing state by the holding current Ib when the valve closing is completed by controlling the force of closing the suction valve 203 by the peak current Ia and the holding current Ib. That is, since the anchor 204 coasts after the control device 800 cuts off the peak current Ia, the force of closing the anchor 204 is reduced as compared with the case where the peak current Ia is given when the valve closing is completed. It is assumed that the control device 800 according to the first embodiment is applied on such a premise.

Figure 8:
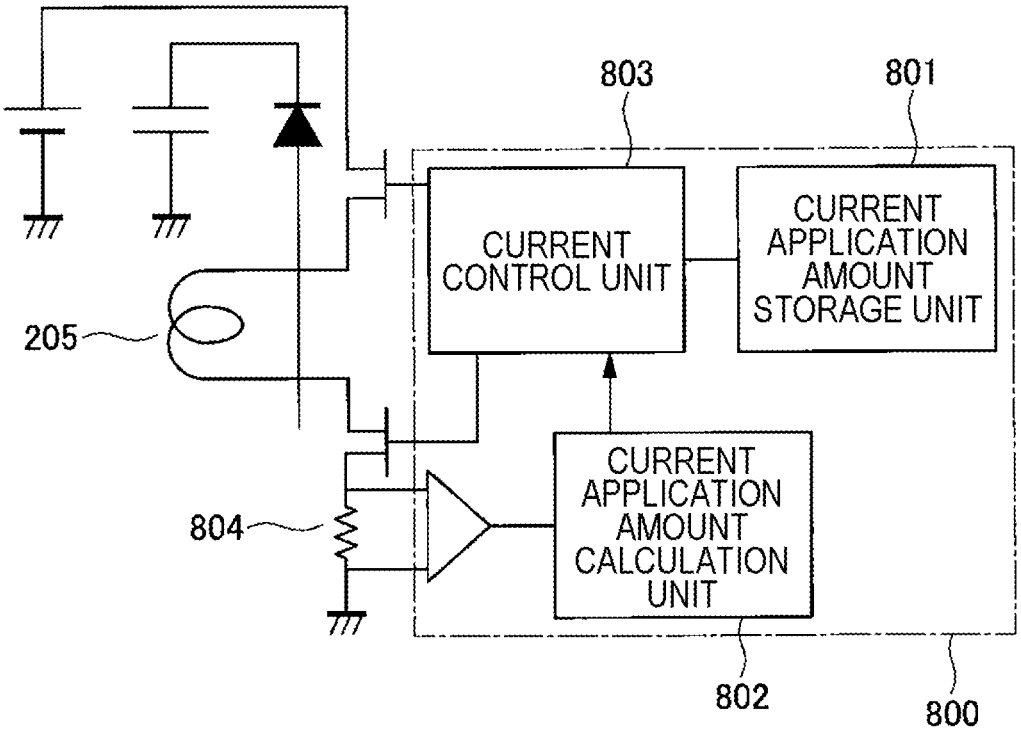
FIG. 8 is a block diagram illustrating an internal configuration example of a control device for a high-pressure fuel pump according to a first embodiment of the present invention.

FIG. 8 is a block diagram illustrating an internal configuration example of the control device 800 of the high-pressure fuel pump 103 according to the first embodiment.

The control device 800 includes a current application amount storage unit 801 that stores a range of the current application amount of the peak current Ia for saturating the valve closing speed, a current application amount calculation unit 802 that calculates the current application amount of the peak current Ia, and a current control unit 803 that controls the current energized to the solenoid 205 based on the range of the current application amount of the peak current Ia and the current application amount of the peak current Ia.

The current application amount storage unit 801 stores the range of the current application amount of the peak current Ia for saturating the valve closing speed. This range is a range (an example is shown in the dead zone 500 in FIG. 5) in which the force of closing the suction valve 203 and the vibration and noise at the time of closing the valve are saturated when the control device 800 reduces the peak current integral value II from the value sufficient to close the high-pressure fuel pump 103. The current application amount storage unit 801 corresponds to the function of the storage element 305 illustrated in FIG. 2. For example, the current application amount storage unit 801 stores, as map information or the like, the relationship between the peak current integral value II and the valve-closing-completion-immediately-preceding speed vel_tb illustrated in FIG. 5.

In order for the current control unit 803 to control the current I, the current application amount calculation unit 802 calculates the current application amount by integrating the current I energized to the solenoid 205.

When the current application amount (peak current integral value II) to the solenoid 205 reaches any value (current application amount limit value) set in the range of the current application amount stored in the current application amount storage unit 801, the current control unit 803 switches from the peak current Ia to the holding current Ib. The current control unit 803 corresponds to the function of the power supply control circuit 306 illustrated in FIG. 2.

Figure 9:
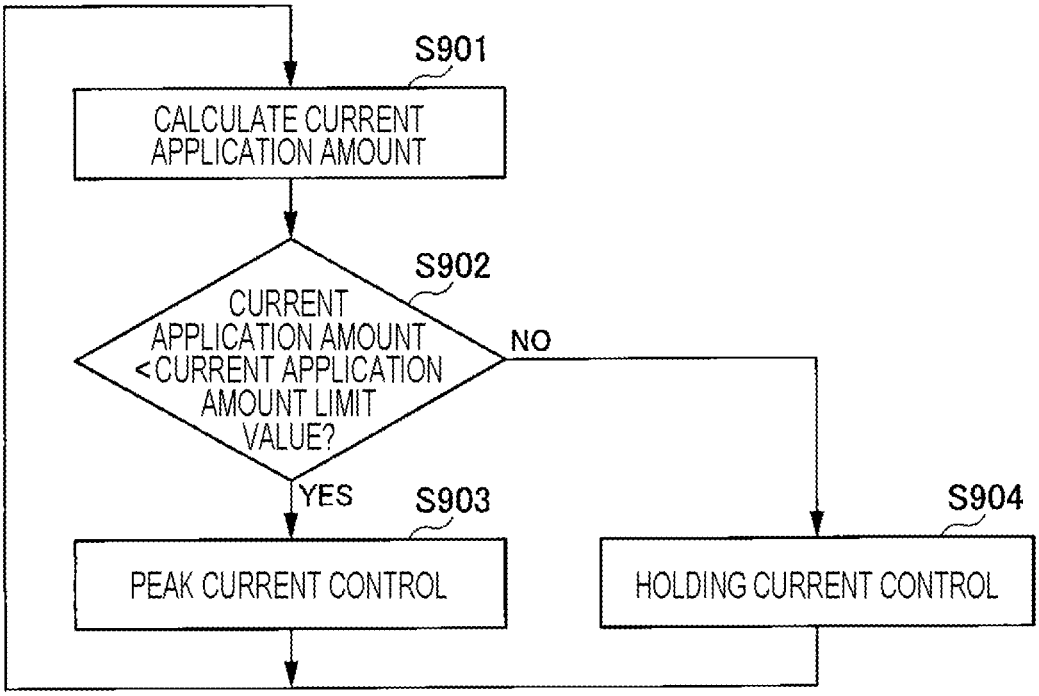
FIG. 9 is a flowchart illustrating an example of an operation of the control device for a high-pressure fuel pump according to the first embodiment of the present invention.

FIG. 9 is a flowchart illustrating an example of an operation of the control device 800 of the high-pressure fuel pump 103.

The current I flowing through the solenoid 205 is taken into the control device 800 after processing such as conversion into a voltage by the shunt resistor 804 is performed.

The current application amount calculation unit 802 calculates the current application amount (peak current integral value II) by integrating the current I taken into the control device 800 (S901). The current application amount storage unit 801 stores, as the current application amount limit value, a value at a right end 501 of the dead zone 500 indicated by the relationship between the peak current integral value II and the valve-closing-completion-immediately-preceding speed vel_Tb illustrated in FIG. 5.

Subsequently, the current control unit 803 compares the current application amount (peak current integral value II) calculated by the current application amount calculation unit 802 with the current application amount limit value stored in the current application amount storage unit 801 (S902). When the current application amount (peak current integral value II) does not exceed the current application amount limit value (YES in S902), the current control unit 803 executes peak current control such that the peak current Ia is maintained (S903). On the other hand, when the current application amount (peak current integral value II) exceeds the current application amount limit value (NO in S902), the current control unit 803 shifts from the peak current Ia to the application of the holding current Ib and executes holding current control (S904).

The control device 800 repeats the control of the flow illustrated in FIG. 9 for each control cycle, and thus, the current application amount indicated by the peak current integral value II is controlled within the range of the dead zone 500. Accordingly, the speed of the anchor 204 at the time of valve closing is saturated. That is, since the speed of the anchor 204 is saturated at the lower limit speed at which the suction valve 203 can be closed, noise and vibration are also saturated at a minimum value. Since the speed of the anchor 204 is saturated and the noise and the vibration are also saturated, it is possible to avoid the valve closing failure of the high-pressure fuel pump 103 while controlling the valve closing speed and the noise and the vibration to a smallest values even though the control device 800 does not control the speed of the anchor 204 near the current application amount that reaches the valve closing limit.

The current control unit (power supply control circuit 306) of the control device 800 according to the first embodiment described above reduces the peak current Ia of the current I energized to the solenoid 205 before a timing at which the anchor 204 is attracted to the fixing portion 206 and collides. For example, the power supply control circuit 306 energizes the peak current Ia to the solenoid 205 until the valve-closing-completion timing Tb, and switches the control of the power supply 112 so as to reduce the peak current Ia before the valve-closing-completion timing Tb. At that time, the current control unit 803 reduces the peak current integral value II within the range of the dead zone 500 in which the valve-closing-completion-immediately-preceding speed vel_tb immediately before the anchor 204 collides with the fixing portion 206 does not change. Thus, the valve-closing-completion-immediately-preceding speed vel_tb becomes a constant value controlled within the dead zone 500, and the generation of the noise and the vibration at the time of driving the high-pressure fuel pump 103 is suppressed. Thus, the low noise of the high-pressure fuel pump 103 can be achieved.

Second Embodiment: Current Control in Dead Zone of Valve-Closing-Completion-Immediately-Preceding Speed vel_Tb with Respect to Valve-Closing-Completion Timing Tb Next, a configuration example and an operation example of a control device of a high-pressure fuel pump according to a second embodiment of the present invention will be described. The high-pressure fuel pump to be controlled in the present embodiment is the same as the high-pressure fuel pump to be controlled in the first embodiment. The control device according to the second embodiment controls the valve opening and closing of the high-pressure fuel pump by the peak current Ia and the holding current Ib in the same manner as the control performed by the control device according to the first embodiment. However, the control device of the high-pressure fuel pump according to the first embodiment controls the peak current integral value II such that the current application amount becomes smaller than the current application amount limit value as illustrated in FIG. 5, whereas the control device of the high-pressure fuel pump according to the second embodiment performs control such that the valve-closing-completion timing Tb is within the range of the saturation region Tr as illustrated in FIG. 7. Thus, the control devices of the first and second embodiments are different.

Figure 10:
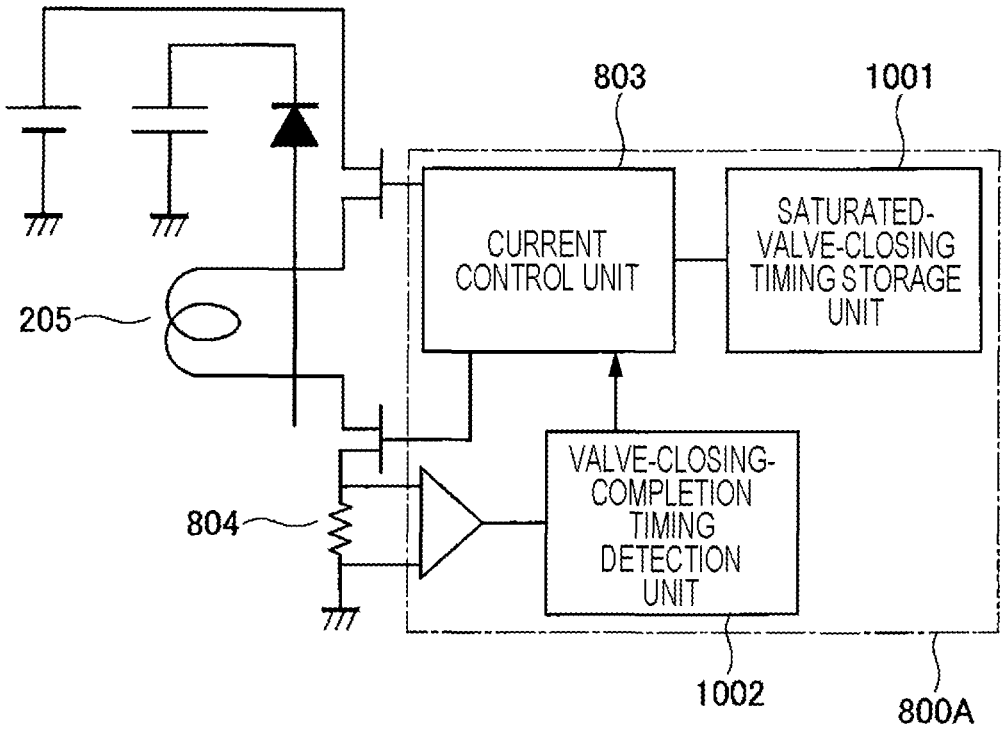
FIG. 10 is a block diagram illustrating an internal configuration example of a control device for a high-pressure fuel pump according to a second embodiment of the present invention.

FIG. 10 is a block diagram illustrating a configuration example of a control device 800A of the high-pressure fuel pump 103 according to the second embodiment.

Figure 14:
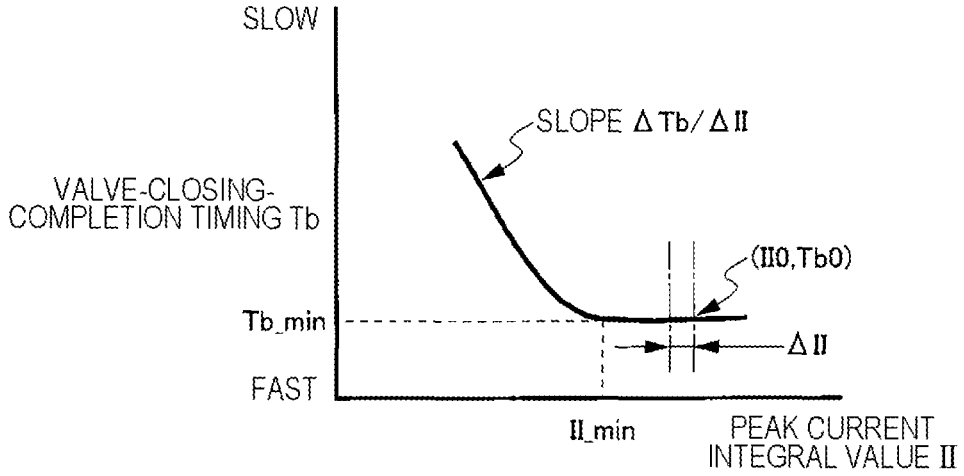
FIG. 14 is a diagram illustrating a relationship between a peak current integral value calculated in step S1301 of FIG. 13 and a valve-closing-completion timing detected in step S1302.

When the application amount of the peak current Ia is reduced from the value sufficient to close the high-pressure fuel pump 103, there is a relationship in which the valve-closing-completion timing Tb of the suction valve 203 is a constant value Tb min until the current application amount of the peak current Ia reaches a predetermined value as illustrated in FIG. 14 to be described later and the valve-closing-completion timing Tb becomes slow when the current application amount of the peak current Ia becomes equal to or less than the predetermined value. Thus, the control device 800A (see FIG. corresponding to the electromagnetic actuator control device 113 of FIG. 2) of the high-pressure fuel pump 103 performs control such that the valve-closing-completion timing Tb is larger than the constant value Tb min. At this time, the control device 800A performs control such that the valve-closing-completion timing Tb is within the range of the saturation region Tr as illustrated in FIG. 7.

The control device 800A of the high-pressure fuel pump 103 includes a saturated-valve-closing timing storage unit 1001 that stores a saturated-valve-closing timing, a valve-closing-completion timing detection unit 1002 that detects the valve-closing-completion timing Tb, and a current control unit 803 that controls the current application amount based on a relationship between the saturated-valve-closing timing and the valve-closing-completion timing Tb.

As illustrated in FIG. 14 to be described later, when the peak current integral value II is reduced from a large value sufficient to close the high-pressure fuel pump 103, the valve-closing-completion timing Tb is maintained at the constant value Tb min until a certain peak current integral value IImin, and when the current application amount becomes smaller than IImin, the saturated-valve-closing timing storage unit 1001 stores the constant value Tb min of the valve-closing-completion timing at which the valve-closing-completion timing Tb becomes slow. The saturated-valve-closing timing storage unit 1001 corresponds to the function of the storage element 305 illustrated in FIG. 2.

The valve-closing-completion timing detection unit 1002 detects the valve-closing-completion timing Tb. The valve-closing-completion timing detection unit 1002 corresponds to the functions of the current measurement circuit 301, the differentiation circuit 302, the absolute value circuit 303, and the smoothing circuit 304 illustrated in FIG. 2.

The current control unit 803 increases the current application amount to advance the valve-closing-completion timing Tb when the valve-closing-completion timing Tb becomes slower than a target value set slower than a certain value of the saturated-valve-closing timing stored in the saturated-valve-closing timing storage unit 1001, and decreases the current application amount to delay the valve-closing-completion timing Tb when the valve-closing-completion timing Tb is earlier than the target value. For example, as illustrated in FIG. 7, when the valve-closing-completion timing Tb is larger (slower) than the target value Tb_tar set to be slower than the constant value Tb min, the current control unit 803 increases the peak current integral value II to advance the valve-closing-completion timing Tb. Conversely, when the valve-closing-completion timing Tb is smaller (earlier) than the target value Tb_tar, the current control unit 803 reduces the peak current integral value II to delay the valve-closing-completion timing Tb. The target value Tb_tar is any value set within the set range of the saturation region Tr in FIG. 7.

Figure 11:
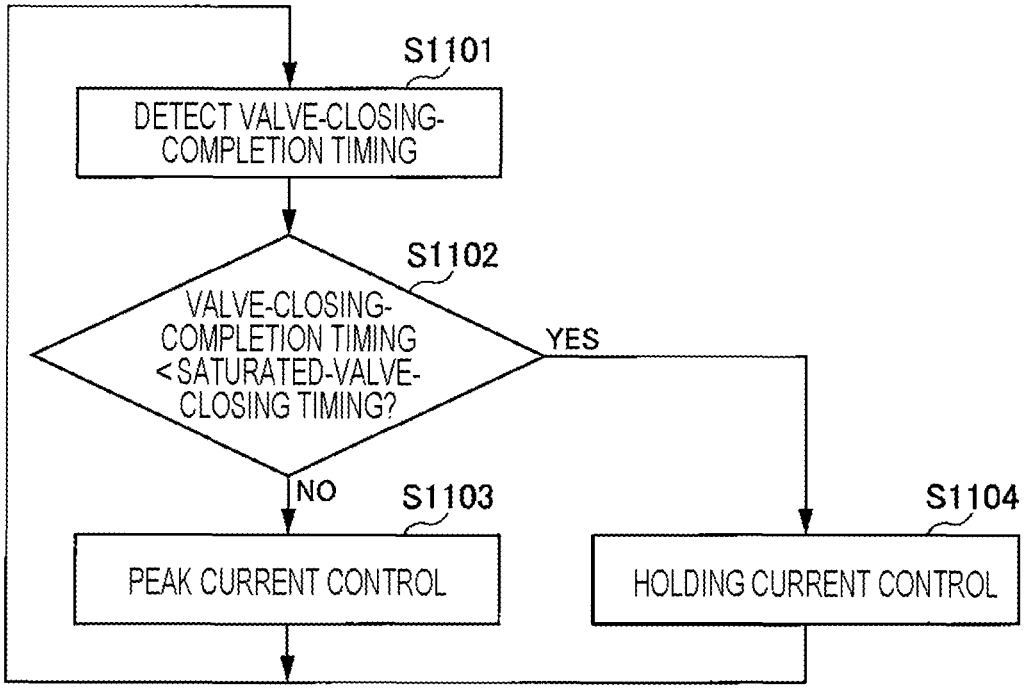
FIG. 11 is a flowchart illustrating an example of an operation of the control device for a high-pressure fuel pump according to the second embodiment of the present invention.

FIG. 11 is a flowchart illustrating an example of an operation of the control device 800A of the high-pressure fuel pump 103.

The current I flowing through the solenoid 205 is taken into the control device 800A after processing such as conversion into a voltage by the shunt resistor 804 is performed.

When the closing of the high-pressure fuel pump 103 is completed, a switching frequency of the current I flowing through the solenoid 205 changes due to a change in an inductance L. The valve-closing-completion timing detection unit 1002 recognizes, as the valve-closing-completion timing Tb, a timing at which the switching frequency of the current I changes by the method illustrated in FIG. 16 to be described later (S1101).

The current control unit 803 determines whether or not the valve-closing-completion timing Tb is earlier than the saturated-valve-closing timing (S1102).

When the valve-closing-completion timing Tb is slower than the saturated-valve-closing timing (NO in S1102), the current control unit 803 executes the peak current control for maintaining the peak current Ia (S1103), and returns to step S1101.

When the valve-closing-completion timing is earlier than the saturated-valve-closing timing (YES in S1102), the current control unit 803 shifts to the holding current control for applying the holding current Ib from the peak current Ia (S1104), and returns to step S1101.

Here, the saturated-valve-closing timing storage unit 1001 stores the relationship between the valve-closing-completion timing Tb and the valve-closing-completion-immediately-preceding speed vel_Tb illustrated in FIG. 7. As described above, for example, a right end of the saturation region Tr illustrated in FIG. 7 is stored as the saturated-valve-closing timing Tb max, and a left end is stored as the saturation valve closing timing Tb min. For example, the current control unit 803 compares the valve-closing-completion timing Tb detected by the valve-closing-completion timing detection unit 1002 with the saturated-valve-closing timing Tb max stored in the saturated-valve-closing timing storage unit 1001.

When the valve-closing-completion timing Tb is larger (slower) than the target value Tb_tar larger than the constant value Tb min, the current control unit 803 increases the peak current integral value II to advance the valve-closing-completion timing Tb. Conversely, when the valve-closing-completion timing Tb is smaller (earlier) than the target value Tb_tar, the current control unit 803 reduces the peak current integral value II to delay the valve-closing-completion timing Tb.

The control device 800A repeats the control of the flow illustrated in FIG. 11 for each control cycle, and thus, the valve-closing-completion timing Tb is controlled within the set range of the saturation region Tr, and the speed of the anchor 204 is saturated at the lower limit speed at which the valve can be closed. The speed of the anchor 204 is saturated and the noise and the vibration are also saturated, and thus, it is possible to avoid the valve closing failure of the high-pressure fuel pump 103 while controlling the valve closing speed, the noise, and the vibration to the smallest values even though the control device 800A does not control the speed of the anchor 204 near the current application amount that reaches the valve closing limit. Since the control device 800A suppresses the noise and the vibration of the high-pressure fuel pump 103, it is possible to achieve the low noise of the high-pressure fuel pump 103.

Third Embodiment: Current Control Using Ratio Between Change Amount of Valve-Closing-Completion Timing Tb and Change Amount of Current Application Amount II Next, a configuration example and an operation example of a control device of a high-pressure fuel pump according to a third embodiment of the present invention will be described. The high-pressure fuel pump to be controlled in the present embodiment is the same as the high-pressure fuel pump to be controlled in the first embodiment. The control device according to the third embodiment controls the valve opening and closing of the high-pressure fuel pump by the peak current Ia and the holding current Ib in the same manner as the control performed by the control device according to the first embodiment. In the first embodiment, it is necessary to store information regarding the dead zone of the valve-closing-completion-immediately-preceding speed vel_Tb. However, in the third embodiment, since the control is performed based on the change in the valve-closing-completion timing Tb detected when the peak current integral value II changes, the storage regarding the dead zone is unnecessary. Specifically, control is performed based on the fact that when the peak current integral value II is larger than the maximum value of the peak current integral value II in the dead zone, the valve-closing-completion timing Tb is constant even though the peak current integral value II changes, but when the peak current integral value II is smaller than the maximum value of the peak current integral value II in the dead zone, the valve-closing-completion timing Tb also changes due to the change in the peak current integral value II. When the peak current integral value II gradually decreases from the peak current integral value II sufficiently larger than the peak current integral value II necessary for closing the valve, a point at which the valve-closing-completion timing Tb starts to change is recognized as an end point of the dead zone.

Figure 12:
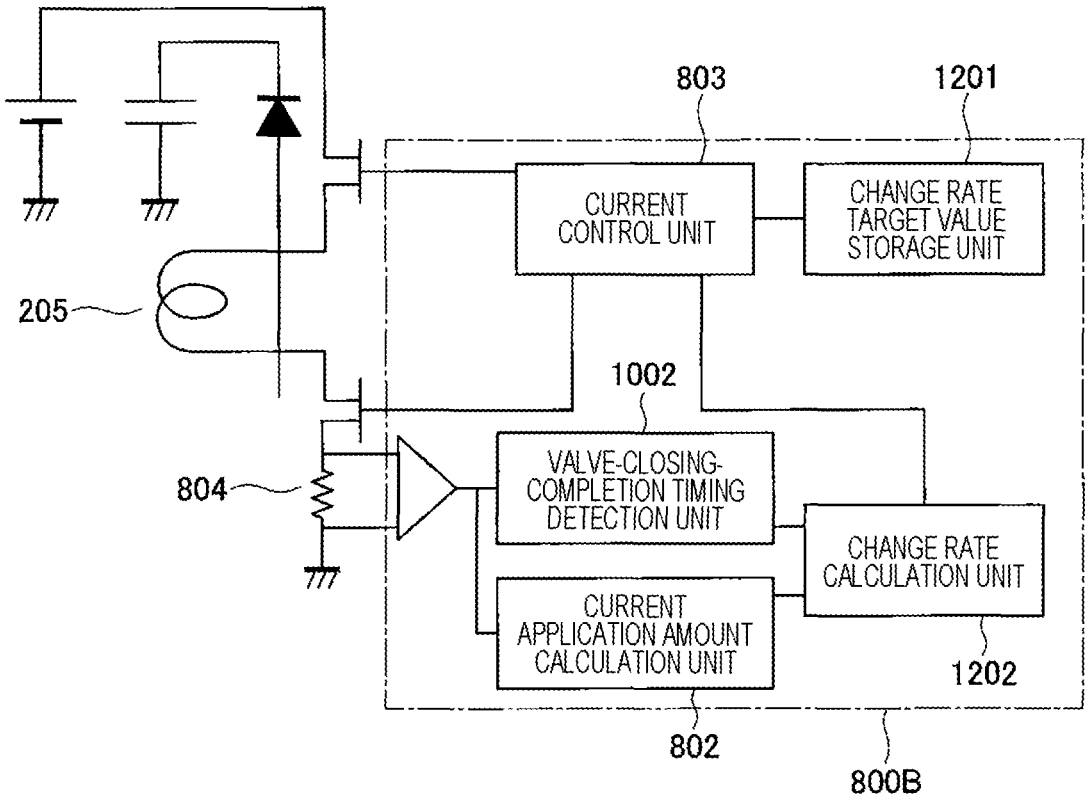
FIG. 12 is a block diagram illustrating an internal configuration example of a control device for a high-pressure fuel pump according to a third embodiment of the present invention.

FIG. 12 is a block diagram illustrating a configuration example of a control device 800B of the high-pressure fuel pump 103 according to the third embodiment.

The control device 800B (see FIG. 12, corresponding to the electromagnetic actuator control device 113 of FIG. 2) of the high-pressure fuel pump 103 controls the current application amount of the peak current Ia such that a change rate indicated by a ratio between the change amount of the current application amount of the peak current and the change amount of the valve-closing-completion timing Tb at which the valve closing of the suction valve 203 is completed exceeds a threshold value. The current application amount, the valve-closing-completion timing Tb, and the valve closing speed have a relationship in which the valve-closing-completion timing Tb is constant even though the current application amount is reduced until the current application amount is reduced from the value sufficient to close the suction valve 203 to a predetermined value and the valve-closing-completion timing Tb becomes slow when the current application amount becomes equal to or less than the predetermined value, and a range in which the change rate does not become smaller than a change rate target value is set as a range in which the valve closing speed is saturated.

The control device 800B includes a current application amount calculation unit 802 that calculates the current application amount, a valve-closing-completion timing detection unit 1002 that detects the valve-closing-completion timing Tb of the suction valve 203, and a change rate target value storage unit 1201 that stores a target value of the change rate. The control device 800B includes a change rate calculation unit 1202 that calculates a change rate indicated by ΔTb/ΔII from the current application amount calculated by the current application amount calculation unit 802 and the valve-closing-completion timing Tb detected by the valve-closing-completion timing detection unit 1002, and a current control unit 803 that controls the current I energized to the solenoid 205 such that the change rate calculated by the change rate calculation unit 1202 matches the target value of the change rate read from the change rate target value storage unit 1201.

The current application amount calculation unit 802 calculates the current application amount from the current energized to the solenoid 205 and outputs the peak current integral value II to the change rate calculation unit 1202.

The valve-closing-completion timing detection unit 1002 detects the valve-closing-completion timing Tb of the suction valve 203. The valve-closing-completion timing detection unit 1002 outputs the valve-closing-completion timing Tb to the change rate calculation unit 1202.

The change rate calculation unit 1202 calculates the change rate based on the change amount of the current application amount and the change amount of the valve-closing-completion timing Tb. For example, the change rate calculation unit 1202 calculates an actual change rate indicated by a ratio ΔTb/ΔII between a change amount ΔII of the peak current integral value II calculated by the current application amount calculation unit 802 and a change amount ΔTb of the valve-closing-completion timing Tb, and outputs the change rate to the current control unit 803. The change rate calculation unit 1202 corresponds to the function of the power supply control circuit 306 illustrated in FIG. 2.

The change rate target value storage unit 1201 stores the change rate target value. The target value (for example, a negative value near zero) of the change rate is indicated by the ratio ΔTb/ΔII between the change amount ΔII of the peak current integral value II and the change amount ΔTb of the valve-closing-completion timing Tb as illustrated in FIG. 14 to be described later. The change rate target value storage unit 1201 corresponds to the function of the storage element 305 illustrated in FIG. 2.

The current control unit 803 controls the current I energized to the solenoid 205 such that the change rate does not become smaller than the target value (for example, a negative value near zero) of the change rate read from the change rate target value storage unit 1201.

Figure 13:
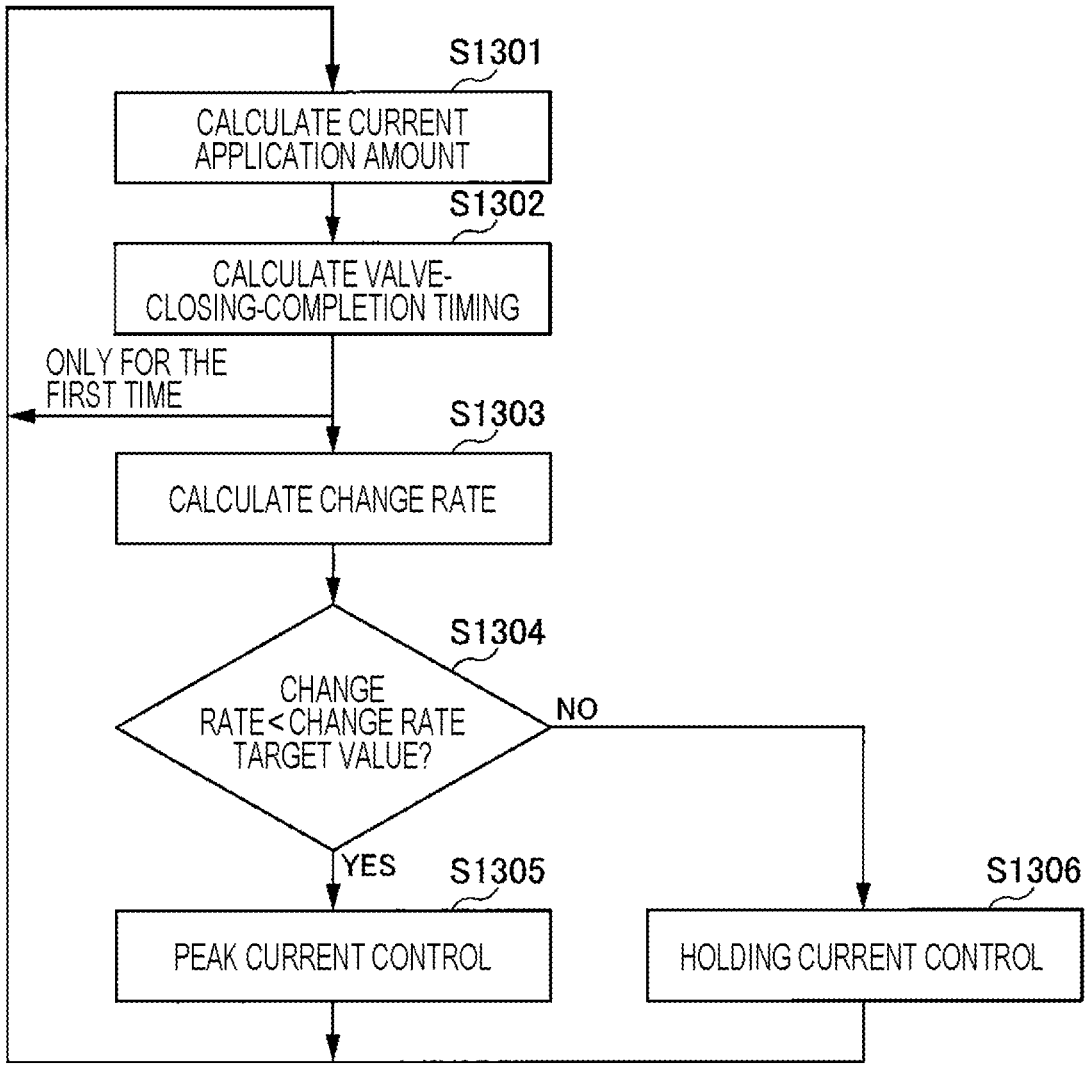
FIG. 13 is a flowchart illustrating an example of an operation of the control device for a high-pressure fuel pump according to the third embodiment of the present invention.

FIG. 13 is a flowchart illustrating an example of an operation of the control device 800B of the high-pressure fuel pump 103.

The control device 800B achieves low noise by gradually decreasing the peak current integral value II from the large value sufficient to close the high-pressure fuel pump 103, detecting the peak current integral value II appropriate for noise reduction, and performing control such that the peak current integral value II becomes this value. However, since the control device 800B cannot directly control the peak current integral value II, for example, the peak current integral value II is indirectly controlled by changing a peak holding time Th indicating a time for holding the peak current Ia from a large value to a small value. Hereinafter, a specific operation of the control device 800B will be described.

First, the control device 800B sets the peak holding time Th to a value Th_0 sufficient to close the high-pressure fuel pump 103. At this time, the current I flowing through the solenoid 205 is taken into the control device 800B after processing such as conversion into a voltage by the shunt resistor 804 is performed.

Subsequently, the current application amount calculation unit 802 integrates the current I taken into the control device 800B to calculate the current application amount (peak current integral value II) (S1301).

When the closing of the high-pressure fuel pump 103 is completed, the switching frequency of the current I flowing through the solenoid 205 changes due to the change in the inductance L of the solenoid 205. The valve-closing-completion timing detection unit 1002 detects the valve-closing-completion timing Tb based on the change in the switching frequency of the current I by the method illustrated in FIG. 16 to be described later (S1302).

In step S1302, the processing returns to first step S1301 for the first time (for example, at startup of the direct injection internal combustion engine 10). This is because a previous value (peak current integral value II or valve-closing-completion timing Tb) is required for the change rate calculation unit 1202 to calculate the change rate ΔTb/ΔII in step S1303.

Here, a procedure in which the control device 800B sets an initial value of the peak current integral value II to II0, sets an initial value of the valve-closing-completion timing Tb to Tb0, and searches for the saturation region Tr will be described.

FIG. 14 is a diagram illustrating a relationship between the peak current integral value II calculated in step S1301 and the valve-closing-completion timing Tb detected in step S1302. In FIG. 14, a horizontal axis indicates the peak current integral value II, and a vertical axis indicates the valve-closing-completion timing Tb.

As illustrated in FIG. 14, as the peak current integral value II becomes large, the valve-closing-completion timing Tb becomes earlier at a slope ΔTb/ΔII. However, when the peak current integral value II becomes larger than a certain value, the slope ΔTb/ΔII becomes a value near zero, and the valve-closing-completion timing Tb does not change. As illustrated in FIG. 5, the valve-closing-completion-immediately-preceding speed Vel_Tb does not change within the dead zone 500, and as illustrated in FIG. 7, the valve-closing-completion-immediately-preceding speed Vel_Tb does not change within the saturation region Tr. That is, since a distance from the start of the movement of the movable element to the valve closing is constant, the valve-closing-completion timing Tb does not change at the valve-closing-completion-immediately-preceding speed Vel_Tb.

FIG. 14 illustrates the change amount ΔII of the peak current integral value II when the slope ΔTb/ΔII becomes a value near zero. The initial value II0 of the peak current integral value II and the initial value Tb0 of the valve-closing-completion timing Tb are specified at a portion indicated as the change amount ΔII of the peak current integral value II.

The initial value II0 is set to the large value sufficient to close the high-pressure fuel pump. The initial value Tb0 is a valve closing timing when the current application amount is II0.

Referring back to FIG. 13, the description is continued.

After first steps S1301 and S1302, the change rate calculation unit 1202 increases the peak holding time Th by a preset step width ΔTh, and re-executes steps S1301 and S1302 to calculate the peak current integral value II and the valve-closing-completion timing Tb.

The change rate calculation unit 1202 calculates the change amount ΔII (difference of the peak current integral value II) of the peak current integral value II by subtracting the initial value II0 from the peak current integral value II. The change rate calculation unit 1202 calculates the change amount ΔTb (difference of the valve-closing-completion timing Tb) of the valve-closing-completion timing Tb by subtracting the initial value Tb0 from the valve-closing-completion timing Tb. Thereafter, the change rate calculation unit 1202 calculates, as the change rate ΔTb/ΔII, a ratio of the change amount ΔTb to the calculated change amount ΔII (S1303).

The current control unit 803 determines whether or not the change rate ΔTb/ΔII calculated in step S1305 is smaller than the change rate target value stored in the change rate target value storage unit 1201 (S1304). When the change rate ΔTb/ΔII is smaller than the change rate target value (YES in S1304), since the valve closing is not completed, the current control unit 803 executes the peak current control such that the peak current Ia is maintained (S1305), and returns to step S1301.

On the other hand, when the change rate ΔTb/ΔII is equal to or more than the change rate target value (NO in S1304), since the valve closing is completed, the current control unit 803 shifts to the holding current control in which the holding current Ib is applied from the peak current Ia (S1306).

As described above, the current control unit 803 of the control device 800B executes the peak current control or the holding current control in a switched manner according to the relationship between the change rate ΔTb/ΔII and the change rate target value. That is, since the control device 800B can perform control such that the relationship between the peak current integral value II and the valve-closing-completion timing Tb falls within the saturation region Tr, the low noise of the high-pressure fuel pump 103 can be achieved. As described above, the valve closing failure causes the pulsation of the fuel pressure, and the pulsation of the fuel pressure causes the variation in the amount of fuel injected from the injector 105. However, in the method according to the present embodiment, since the peak current control and the holding current control can be realized without searching for the valve closing limit, the pressure pulsation of the fuel discharged to the high pressure pipe 104 due to the valve closing failure does not occur.

<<Method for Detecting Valve-Closing-Completion Timing Tb>>

Hitherto, it has been described that the low noise of the high-pressure fuel pump 103 can be achieved by the control device according to the first to third embodiments executing the peak current control and the holding current control at an appropriate timing. However, in order for the control device according to each embodiment to realize control for maintaining the valve-closing-completion timing Tb within the range of the common saturation region Tr, it is necessary to accurately detect the valve-closing-completion timing Tb. Hereinafter, a method for detecting, by each circuit of the electromagnetic actuator control device 113 illustrated in FIG. 2, the valve-closing-completion timing Tb from the current I (holding current Ib) energized to the solenoid 205 will be described with reference to FIGS. 15 to 23.

Figure 15:
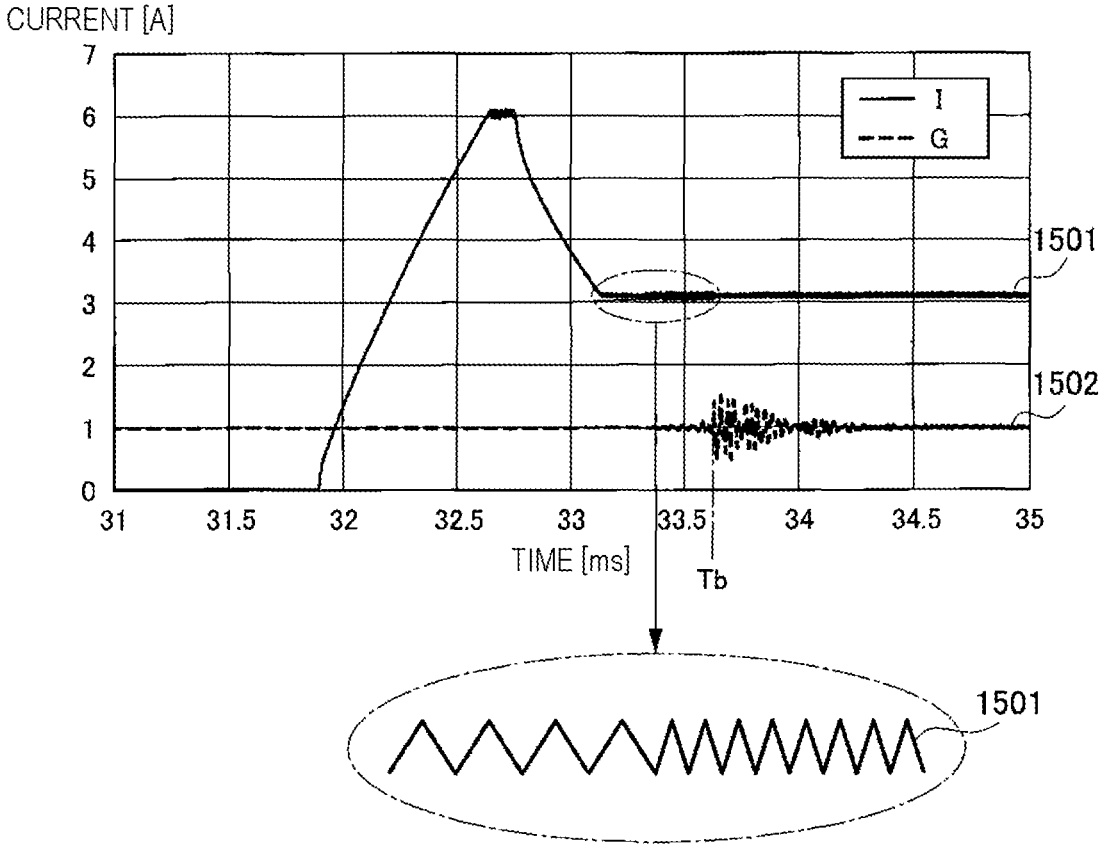
FIG. 15 is a diagram illustrating a scene in which a current changes when valve closing is completed, which is common to the embodiments of the present invention.

FIG. 15 is a diagram illustrating a scene in which the current I changes when the valve closing is completed. Here, a graph 1501 representing a change in the current I supplied to the solenoid 205 and a graph 1502 representing a change in an output signal of a vibration sensor are illustrated side by side. The vibration sensor attached to the high-pressure fuel pump is a sensor experimentally added to the high-pressure fuel pump 103 in order to examine the valve-closing-completion timing Tb, and is not illustrated.

A timing at which an amplitude of the output signal of the vibration sensor rapidly increases (position of 33.6 ms) illustrated in the graph 1502 represents the valve-closing-completion timing Tb. It can be seen that a change occurs in a density (the number of lines per unit time) of a switching waveform of the current I shown in the graph 1501 so as to correspond to the valve-closing-completion timing Tb. When a portion where the density of the switching waveform changes is enlarged, a change in the switching frequency can be seen. There is a time difference between an amplitude sudden increase timing of the vibration sensor and a change timing of the switching frequency, and this time difference is a time required for the vibration due to the valve closing completion to be transmitted to the vibration sensor.

The reason why the switching frequency changes due to the valve closing completion will be considered below. The power supply control circuit 306 of the electromagnetic actuator control device 113 according to the present embodiment illustrated in FIG. 2 includes a central processing unit (CPU) or a micro processing unit (MPU), and controls an operation of the power supply 112. For example, the power supply control circuit 306 vibrates the current I supplied to the solenoid 205 in a certain range by switching the voltage applied to the solenoid 205. The anchor 204 is controlled by the current I controlled in this manner. The change in the switching frequency of the current I is a phenomenon that occurs since the magnetic inductance L of the magnetic circuit formed by the anchor 204 and the fixing portion 206 decreases when the anchor 204 approaches the fixing portion 206. This will be described by the following Equation about switching current.

Switching voltages V+ and V− and the current I have the following relationships (2) and (3).

$$L \times dI/dt = V+ - RI \quad \text{Equation (2)}$$

$$L \times dI/dt = V- - RI \quad \text{Equation (3)}$$

Equation (2) shows a relationship between the switching voltage V+ and the current I when the current I rises. Equation (3) shows a relationship between the switching voltage V− and the current I when the current I falls. Since the range of the current I at the time of switching control is limited, it is considered that right sides of Equations (2) and (3) are substantially constant. When the anchor 204 approaches the fixing portion 206 by the valve closing, since the inductance L becomes small, an absolute value of dI/dt=(V−RI)/L becomes large. As a result, the slope of the current I becomes steep, and the frequency becomes high. This is the reason why the switching frequency changes. In the normal control of the high-pressure fuel pump 103, V+ is 14 V as a battery voltage, and V− is 0 V as a ground voltage.

As described above, the switching frequency of the current I changes before and after the valve-closing-completion timing Tb. The electromagnetic actuator control device 113 according to the first to third embodiments performs control such that the timing at which the switching frequency corresponding to the valve-closing-completion timing Tb changes belongs to the common saturation region Tr (see FIG. 7). That is, the power supply control circuit 306 of the electromagnetic actuator control device 113 according to the first to third embodiments performs control such that the timing at which the switching frequency of the current I changes by a set value or more falls within the set range (common saturation region Tr).

This set range is set to be the saturation region Tr (dead zone 500 illustrated in FIG. 5) of the relationship between the current I and the speed of the anchor 204 when the valve is closed (timing when the anchor 204 collides with the fixing portion 206). The set range is set, and thus, the noise due to the collision of the anchor 204 and the suction valve 203 described above can be reduced. Accordingly, the low noise of all the high-pressure fuel pumps 103 can be achieved.

There is a correlation between the speed of the anchor 204 when the high-pressure fuel pump 103 is closed (timing when the anchor 204 collides with the fixing portion 206) and the noise due to impact between the anchor 204 and the fixing portion 206 or collision between the anchor 204 and the fixing portion 206 when the valve is closed. Thus, the set range (common saturation region Tr) may be set to be the saturation region Tr (dead zone 500 in FIG. 5) of the relationship between the current I flowing through the solenoid 205 and the impact when the valve is closed.

The magnitude of the noise is proportional to the square of the speed when the anchor 204 collides with the fixing portion 206. Thus, the above set range may be set to be the saturation region (dead zone 500 in FIG. 5) of the relationship between the current I flowing in the solenoid 205 and the noise when the valve is closed.

Specifically, the current I flowing through the solenoid 205 indicates a current integral value from the start of supply (timing t1) of the peak current Ia to the start of reduction (timing t3) of FIG. 3, a maximum current value of the peak current Ia, or a period (peak current width Th) in which the maximum current value flows.

Thus, it is desirable that the power supply control circuit 306 controls the peak current Ia such that the peak current integral value II calculated from the current integral value from the start of supply (timing t1) to the start of reduction (timing t3) flowing to the solenoid 205, the maximum current value Im of the peak current Ia, or the period (peak current width Th) in which the maximum current value Im flows falls within the saturation region Tr (dead zone 500 in FIG. 5). The noise due to collision of the anchor 204 and the suction valve 203 described above can be reduced by controlling the peak current Ia, and the low noise of all the high-pressure fuel pumps 103 can be achieved.

As described above, it has been found that the low noise of the high-pressure fuel pump 103 can be achieved by the power supply control circuit 306 controlling the peak current integral value II based on the change in the switching frequency. The next problem is to detect this change in switching frequency. In order to capture the change in the switching frequency, processing is performed in a flow illustrated in FIGS. 16A to 16D.

FIGS. 16A to 16D are diagrams illustrating a flow from the change in the switching frequency of the current I flowing in the solenoid 205 to detection of the valve-closing-completion timing Tb.

Figures 16A, 16B, 16C, 16D:
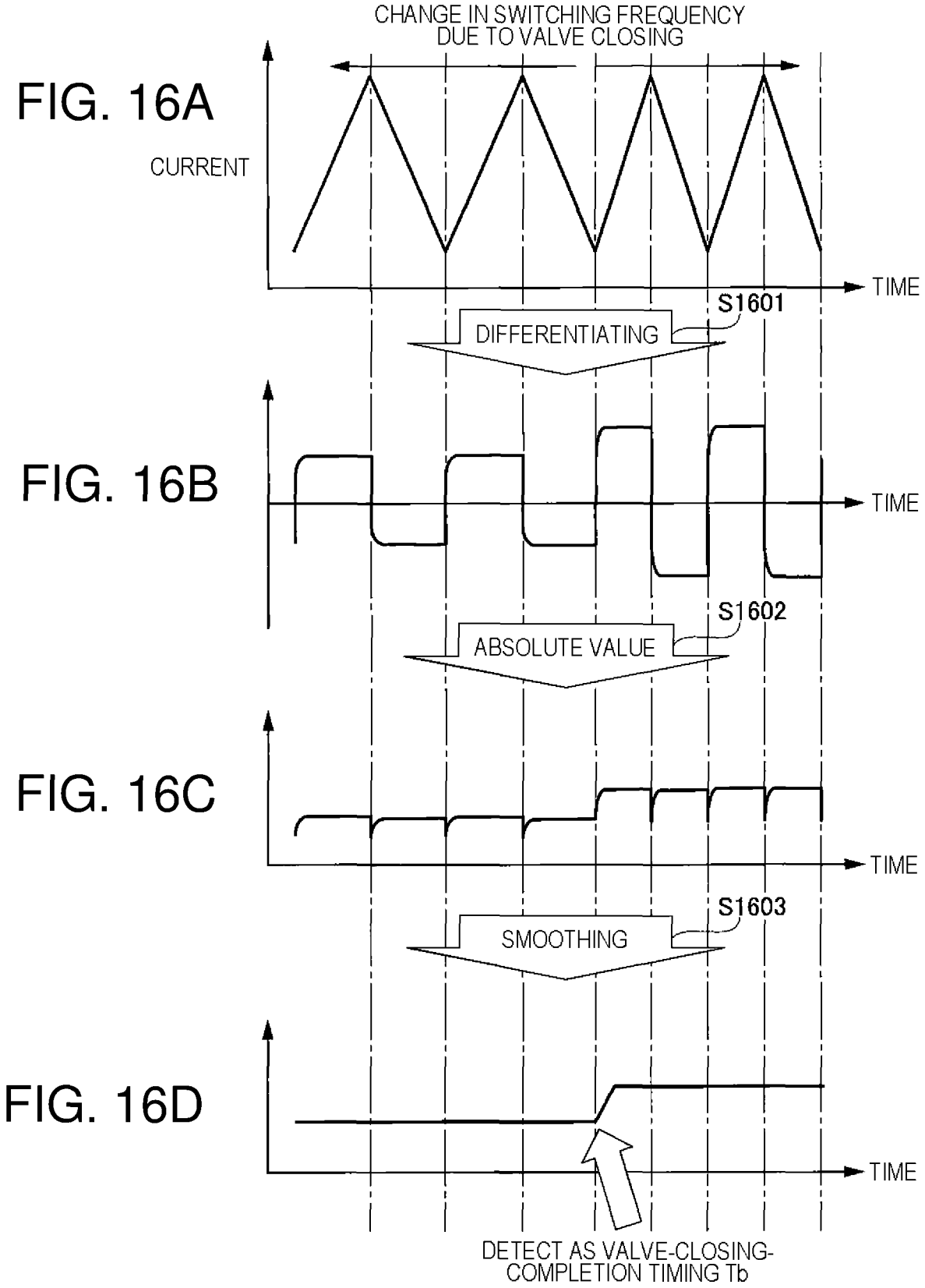
FIGS. 16A to 16D are diagrams illustrating a method for detecting the valve-closing-completion timing from a change in a switching frequency of a current flowing through a solenoid common to the embodiments of the present invention.

As illustrated in a graph FIG. 16A, the switching frequency of the current I (holding current Ib) flowing through the solenoid 205 changes before and after the valve is closed. Thus, the current measurement circuit 301 converts the current I energized to the solenoid 205 into a voltage by a shunt resistor or the like and outputs a voltage signal. The voltage signal output from the current measurement circuit 301 is differentiated by the differentiation circuit 302 illustrated in FIG. 17.

Figure 17:
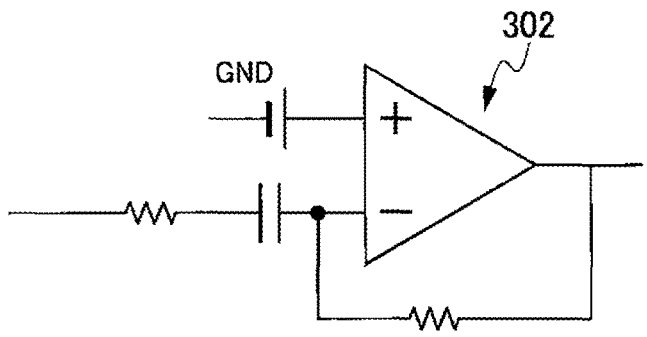
FIG. 17 is a diagram illustrating a configuration example of a differentiation circuit common to the embodiments of the present invention.

FIG. 17 is a diagram illustrating a configuration example of the differentiation circuit 302.

The differentiation circuit 302 differentiates the voltage signal converted by the current measurement circuit 301 (S1601). A result of differentiating the voltage signal by the differentiation circuit 302 is represented by a waveform as illustrated in a graph FIG. 16B.

Since the differentiation result differs between the rising and the falling, a value corresponding to the switching frequency is obtained by sampling near an end of the rising in synchronization with the switching of the current I. However, this sampling applies a load to a microcomputer (hereinafter, abbreviated as "microcomputer") used as the power supply control circuit 306. Thus, the absolute value circuit 303 illustrated in FIG. 18 obtains an absolute value of the differentiation result (S1602).

Figure 18:
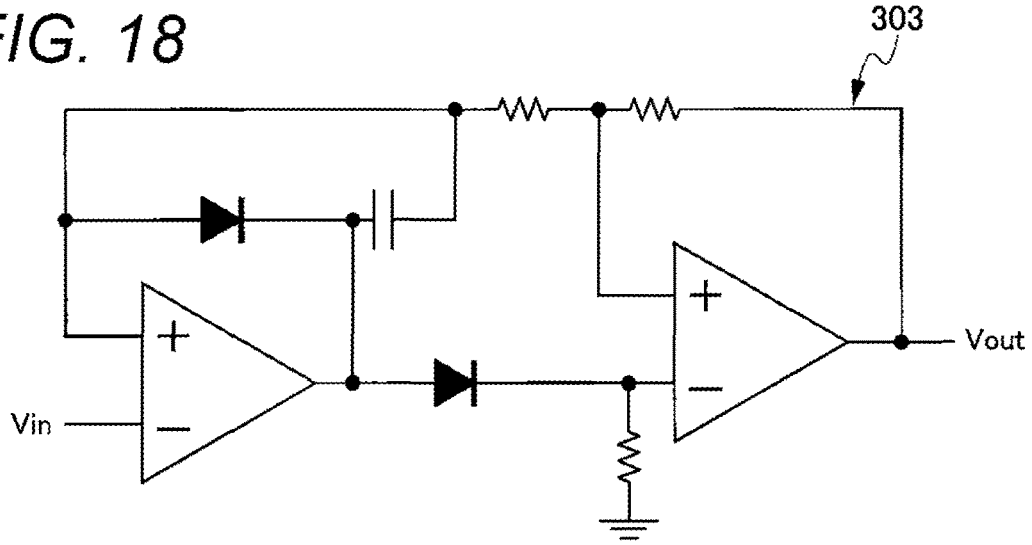
FIG. 18 is a diagram illustrating a configuration example of an absolute value circuit common to the embodiments of the present invention.

FIG. 18 is a diagram illustrating a configuration example of the absolute value circuit 303.

The absolute value circuit 303 is a circuit that outputs an absolute value of an input signal. The absolute value of the differentiation result output from the absolute value circuit 303 is represented by a waveform as illustrated in a graph FIG. 16C.

As illustrated in the graph (3), the absolute value also changes before and after the valve-closing-completion timing Tb. Thus, the smoothing circuit 304 smooths an output (absolute value) of the absolute value circuit 303 with a time constant longer than the switching cycle based on the switching frequency of the current I (S1603). A signal illustrated in a graph FIG. 16D is obtained, and a change indicated by an arrow in the drawing appears at the valve-closing-completion timing Tb. The power supply control circuit 306 detects the valve-closing-completion timing Tb by extracting a change in the signal by a method such as threshold value determination.

As described above, the electromagnetic actuator control device 113 according to the first to third embodiments illustrated in FIG. 2 includes the differentiation circuit 302 that differentiates the current I, the absolute value circuit 303 that obtains the absolute value of the output of the differentiation circuit 302, and the smoothing circuit 304 that smooths the output of the absolute value circuit 303 with the time constant longer than the cycle based on the switching frequency. The power supply control circuit 306 of the electromagnetic actuator control device 113 extracts a change point of an output of the smoothing circuit 304 and detects the valve-closing-completion timing Tb.

This method may be performed by an analog circuit until the signal is smoothed. Thereafter, when a function of performing AD conversion on the smoothed waveform illustrated in the graph FIG. 16D, taking the waveform into the microcomputer (power supply control circuit 306), and specifying the change point corresponding to the change in the frequency is realized by the microcomputer, a processing load of the microcomputer can be reduced. On the other hand, since it is necessary to realize the differentiation circuit 302 and the absolute value circuit 303 by analog circuits, the cost of each circuit element increases, and an area of a board on which a circuit element is mounted increases.

Thus, an embodiment in which the valve-closing-completion timing Tb can be detected when there is a margin in the processing capacity of the microcomputer (power supply control circuit 306) will be described with reference to FIGS. 19 and 20.

Figure 19:
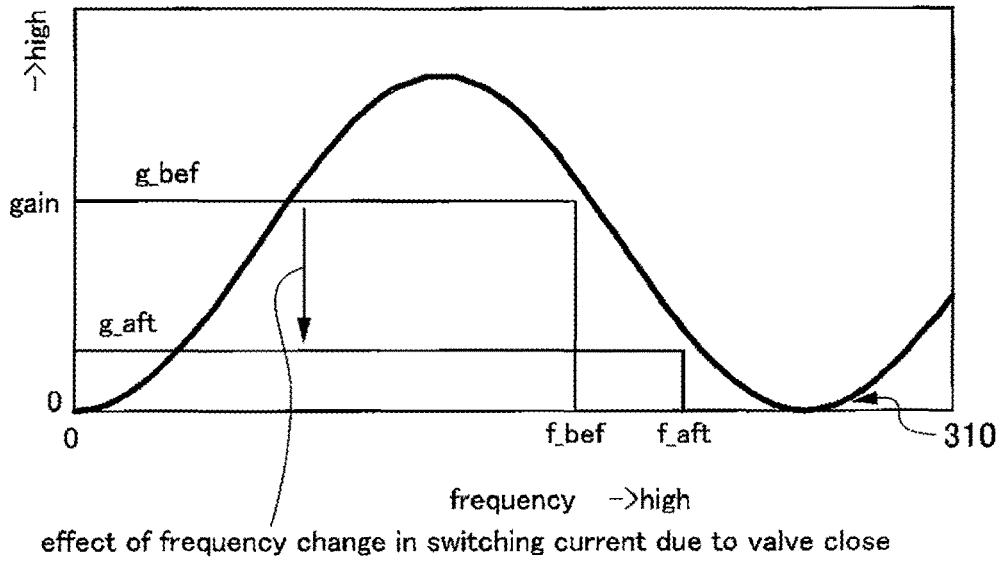
FIG. 19 is a diagram illustrating frequency-gain characteristics of a filter common to the embodiments of the present invention.

FIG. 19 is a diagram illustrating frequency-gain characteristics of a filter 310.

Figure 20A:
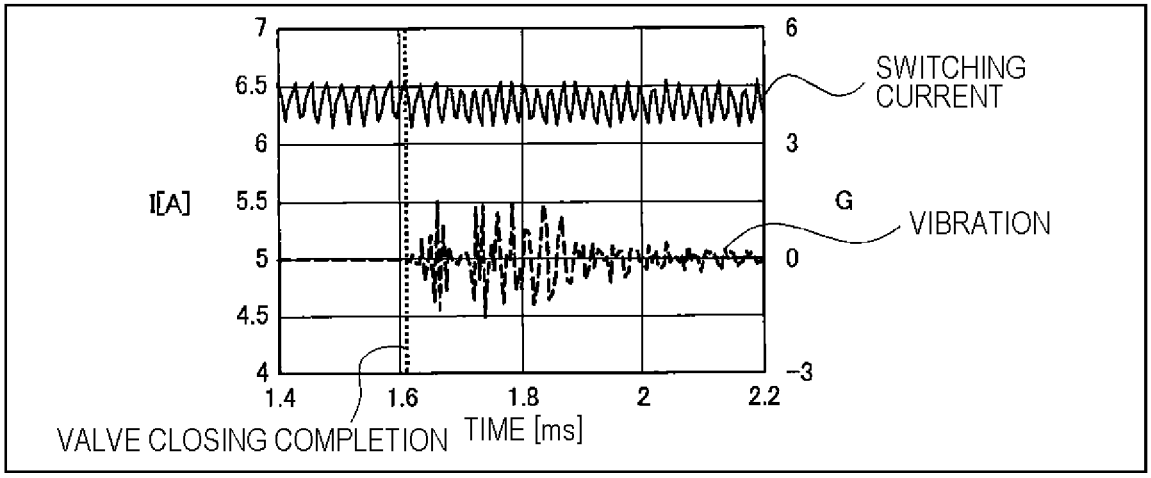
FIGS. 20A to 20C are diagrams illustrating a scene in which a switching current signal input to a filter common to the embodiments of the present invention changes.
Figure 20B:
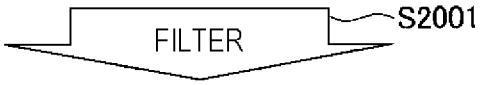
Figure 20B:
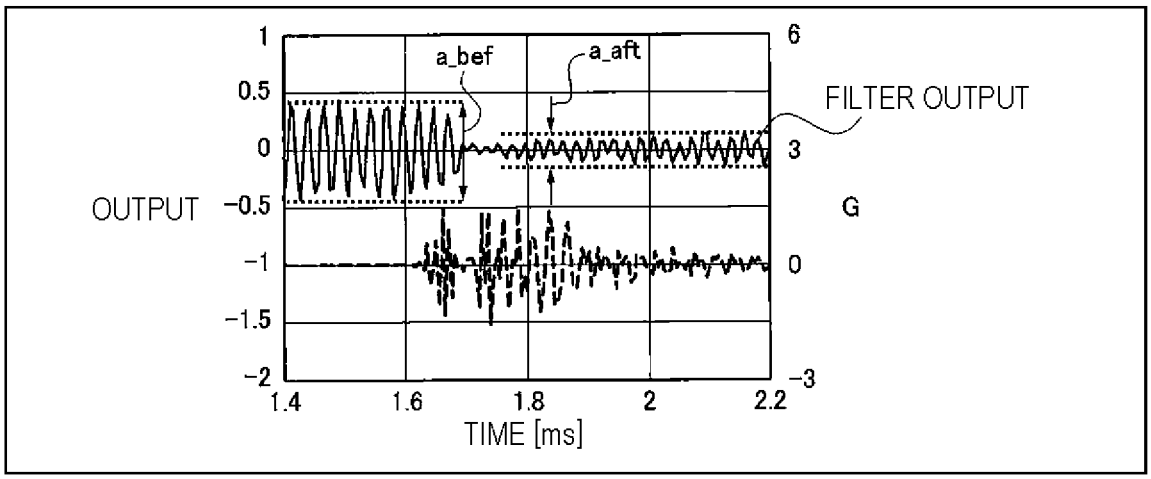
Figure 20C:
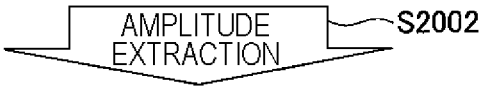
Figure 20C:
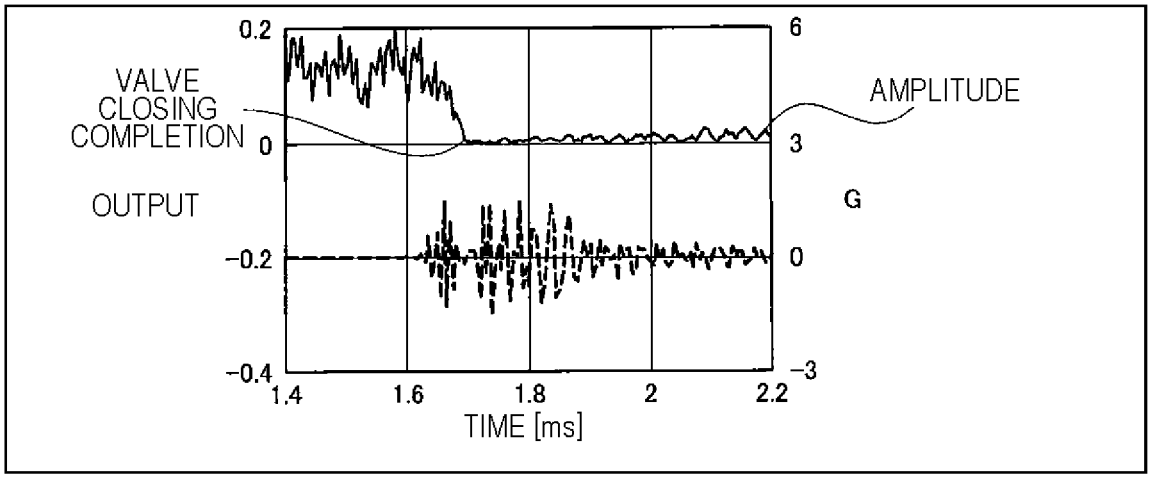

FIGS. 20A to 20C are diagrams illustrating a scene in which a signal of the current I ("switching current signal") input to the filter 310 changes.

The filter 310 according to the present embodiment is a circuit used in place of the differentiation circuit 302, the absolute value circuit 303, and the smoothing circuit 304 included in the electromagnetic actuator control device 113 illustrated in FIG. 2. From the frequency-gain characteristics of the filter 310, when a gain g_bef for a frequency f_bef before the anchor 204 illustrated in FIG. 2 collides with the fixing portion 206 and a gain g aft for a frequency f aft after the collision are compared with each other, a relationship illustrated in the following Equation (4) is obtained.

$$g_bef > g_aft \quad \text{Equation (4)}$$

When the switching current signal before and after the collision as illustrated in a graph FIG. 20A is input to the filter 310 (S2001), the output is illustrated as a graph FIG. 20B. Here, "vibration" illustrated in graph FIG. 20A represents an output signal of the vibration sensor. The graphs of "vibration" illustrated in graphs FIGS. 20B and 20C also represent output signals of the same vibration sensor.

As in the graph FIG. 20A, the amplitude of the switching current signal is the same before and after the collision, but the filter output changes before and after the collision of the anchor 204 and the fixing portion 206 due to the change in the frequency of the switching current signal before and after the collision as in the graph FIG. 20B.

The amplitude of the current I input to the filter 310 is substantially the same before and after the collision between the anchor 204 and the fixing portion 206, but there is a relationship shown in Equation (5) between an amplitude a_bef of the output signal before the collision and an amplitude a_aft after the collision.

$$a_bef > a_aft \quad \text{Equation (5)}$$

As described above, since the gain of the filter 310 is different before and after collision, when signals having the same amplitude are input to the filter 310, a difference in gain becomes a difference in output, and thus, the relationship shown in Equation (5) appears. Thus, when the amplitude of the current I is extracted, a change in the output signal illustrated in the graph FIG. 20C appears (S2002).

When the electromagnetic actuator control device 113 obtains the absolute value of the output signal and smooths the absolute value with the filter 310 having a cutoff frequency lower than the switching frequency, a change appears in the frequency of the output signal as illustrated in the graph FIG. 20C. The power supply control circuit 306 can specify the valve-closing-completion timing Tb (near 1.7 ms) by specifying a timing of this change point.

In the embodiment described so far, the gain before and after the collision is expressed by the above-described Equation (4). However, the gain before and after the collision may be expressed by Equation (6).

$$g_bef < g_aft \quad \text{Equation (6)}$$

Figure 21:
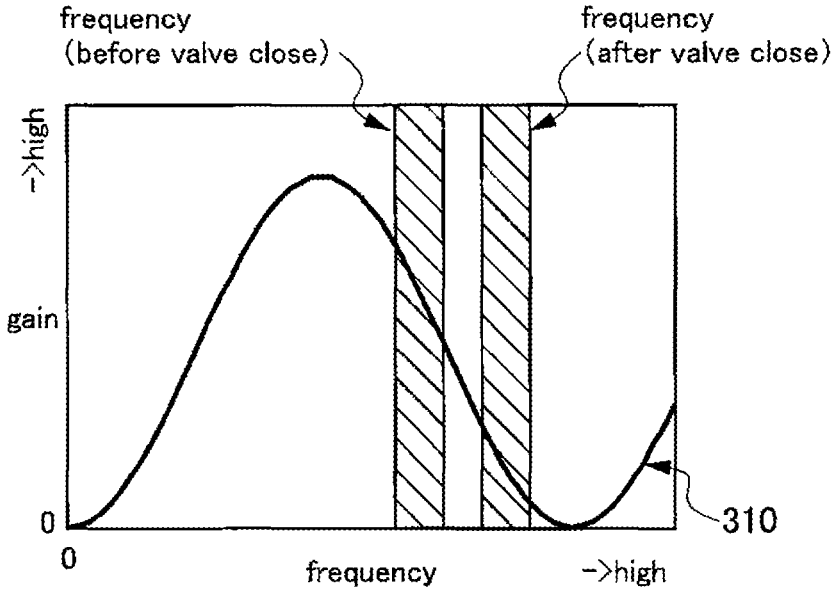
FIG. 21 is a diagram illustrating a relationship between a gain and a frequency before and after an anchor common to the embodiments of the present invention collides with a fixing portion.

It is also considered that the frequencies before and after the collision are distributed in a certain range illustrated in FIG. 21 depending on conditions such as a temperature.

FIG. 21 is a diagram illustrating a relationship between a frequency and a gain before and after the anchor 204 collides with the fixing portion 206.

FIG. 21 illustrates that the frequency change of the current I due to the collision of the anchor 204 with the fixing portion 206 can be detected by using the filter 310 in which the gain monotonously increases or monotonously decreases in the frequency region before and after the collision.

Here, when the suction valve 203 of the high-pressure fuel pump 103 is closed, the inductance L in the magnetic circuit between the anchor 204 and the fixing portion 206 changes. As illustrated in FIG. 15, the slope of the current I flowing through the solenoid 205 changes due to the change in the inductance L. This appears in the change in the switching frequency of the current I.

The amplitude of the current I is controlled to be constant before and after the suction valve 203 is closed. Thus, when a filter having a different gain is used with respect to the switching frequency before and after valve closing, the amplitude of the current I after filtering is different before and after valve closing. Thus, the control device (electromagnetic actuator control device 113) of the high-pressure fuel pump 103 according to the first to third embodiments can detect the valve-closing-completion timing Tb of an electromagnetic actuator 200 by extracting the amplitude of the current I and specifying the change point of the amplitude.

Here, a configuration example and an operation example of the valve-closing-completion timing detection unit that detects the valve-closing-completion timing Tb based on a change in the amplitude of the current I will be described with reference to FIG. 22.

Figure 22:
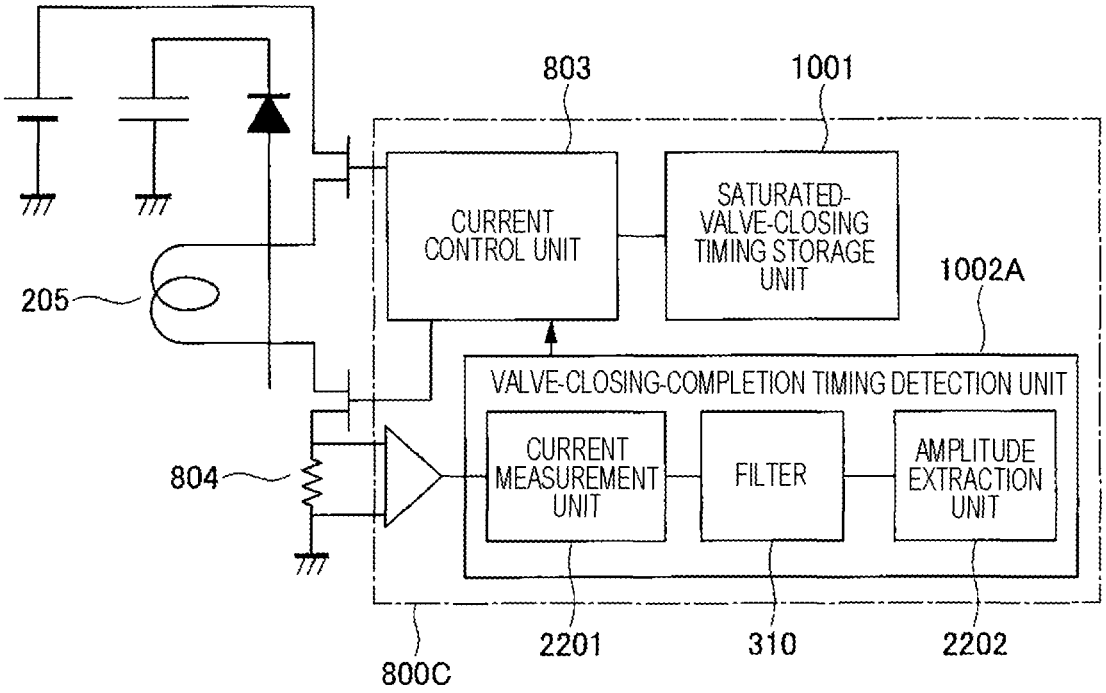
FIG. 22 is a flowchart illustrating an operation example of a valve closing detection device (electromagnetic actuator control device) common to the embodiments of the present invention.

FIG. 22 is a block diagram illustrating a configuration example of a valve-closing-completion timing detection unit 1002A that detects the valve-closing-completion timing Tb.

A control device 800C of the high-pressure fuel pump 103 according to the present embodiment includes the valve-closing-completion timing detection unit 1002A in addition to the current control unit 803 and the saturated-valve-closing timing storage unit 1001 described above.

The valve-closing-completion timing detection unit 1002A may be provided in the control device according to each embodiment instead of the valve-closing-completion timing detection unit 1002 according to the second and third embodiments described above. The valve-closing-completion timing detection unit 1002A includes a current measurement unit 2201, a filter 310, and an amplitude extraction unit 2202.

The current measurement unit 2201 measures the current I flowing through the solenoid 205. Thus, the current measurement unit 2201 has a function corresponding to an analog-to-digital (AD) converter.

The filter 310 has different gain characteristics from the switching frequency of the current measured before and after the suction valve 203 shifts to the valve closing state. For example, the filter 310 has different gain characteristics from the frequency of the current I before and after the timing at which the mover (anchor 204) collides with the fixing portion 206.

The amplitude extraction unit 2202 extracts the amplitude of the output obtained from the filter 310 to which the current I is input, and detects the change point of the amplitude as the valve-closing-completion timing Tb.

Figure 23:
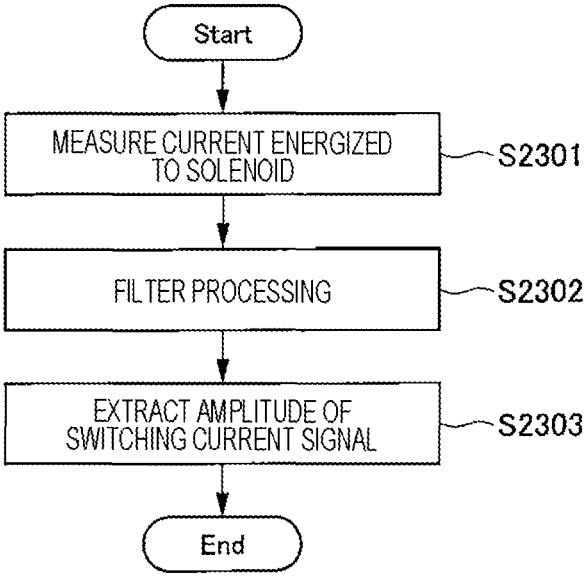
FIG. 23 is a flowchart illustrating an example of an operation of a valve-closing-completion timing detection unit common to the embodiments of the present invention.

FIG. 23 is a flowchart illustrating an example of an operation of the valve-closing-completion timing detection unit 1002A.

The current measurement unit 2201 measures the current I flowing through the solenoid 205 (S2301).

Subsequently, the current signal of the current I flowing through the solenoid 205 measured by the current measurement unit 2201 is filtered by the filter 310 having the gain different between the frequency after the valve closing and the frequency before the valve closing (S2302).

The amplitude extraction unit 2202 extracts a component of the switching current signal from the filtering result (S2303).

The valve-closing-completion timing detection unit 1002A estimates a timing at which the movable element (anchor 204) collides with the fixing portion 206 based on the change in the amplitude output from the amplitude extraction unit 2202. That is, the valve-closing-completion timing detection unit 1002A can detect the valve-closing-completion timing Tb of the electromagnetic actuator 200 by estimating the collision timing.

As described with reference to FIG. 5, it has been found that the valve-closing-completion-immediately-preceding speed vel_Tb and the noise can be reduced as the current I given to the high-pressure fuel pump 103 is reduced, but the valve-closing-completion-immediately-preceding speed vel_Tb and the noise are saturated when the current I is reduced to some extent. As a result of examining the relationship between the valve-closing-completion timing Tb, the valve-closing-completion-immediately-preceding speed vel_Tb, and the noise, as shown in FIG. 7, it has been found that there is the common saturation region Tr even though the individual characteristics of the high-pressure fuel pump 103 vary.

Thus, the power supply control circuit 306 (current control unit 803) of the electromagnetic actuator control device 113 reduces the current I given to the solenoid 205 of the high-pressure fuel pump 103. When the valve-closing-completion timing Tb is delayed, the electromagnetic actuator control device 113 controls the current I such that the valve-closing-completion timing Tb detected by the valve-closing-completion timing detection unit 1002A belongs to the common saturation region Tr that does not depend on the valve-closing-completion-immediately-preceding speed vel_Tb or the variation in the individual characteristics of the saturation region Tr when the noise is saturated. The current I is controlled by the electromagnetic actuator control device 113 in this manner, and thus, the low noise of the high-pressure fuel pump 103 can be achieved.

The present invention is not limited to the above-described embodiments, and various other application examples and modification examples can be acquired without departing from the gist of the present invention described in the claims.

For example, the above-described embodiments are to describe the configurations of the devices and the systems in detail in order to facilitate easy understanding of the present invention, and do not necessarily include all the described configurations. A part of the configurations of the embodiments described herein can be replaced with configurations of other embodiments, and the configurations of other embodiments can be added to the configuration of one embodiment. Additions, the components of another embodiment can be added, removed, and substituted to, from, and into some of the components of the aforementioned embodiments.

Furthermore, control lines and information lines illustrate lines which are considered to be necessary for the description, and not all the control lines and information lines in a product are necessarily illustrated. Almost all the configurations may be considered to be actually connected to each other.

REFERENCE SIGNS LIST

10 direct injection internal combustion engine
103 high-pressure fuel pump
112 power supply
113 electromagnetic actuator control device
114 ECU
203 suction valve
204 anchor
205 solenoid
206 fixing portion
301 current measurement circuit
302 differentiation circuit
303 absolute value circuit
304 smoothing circuit
305 storage element
306 power supply control circuit
310 filter
500 dead zone
800 control device
801 current application amount storage unit
802 current application amount calculation unit
803 current control unit

The invention claimed is:

1. A control device for a high-pressure fuel pump that controls a suction valve that opens and closes an inflow port through which fuel flows to a pressurizing chamber by performing energization to a solenoid in synchronization with a reciprocating motion of a plunger, wherein a current energized to the solenoid includes a peak current for giving a force to start closing the suction valve from a stationary state and a holding current for performing switching in a range smaller than a maximum value of the peak current in order to hold the suction valve in a valve closing state, when the peak current is reduced from a value sufficient to close the suction valve of the high-pressure fuel pump, there is a relationship in which a valve-closing-completion timing at which closing of the suction valve is completed is a constant value until a current application amount of the peak current reaches a predetermined value and the valve-closing-completion timing becomes slow when the current application amount of the peak current is equal to or less than the predetermined value, control is performed such that the valve-closing-completion timing becomes larger than the constant valve, and a saturated-valve-closing memory configured to store the constant value of the valve-closing completion timing as a saturated-valve-closing timing;

a valve-closing-completion sensor configured to detect the valve-closing-completion timing; and a current controller configured to increase the current application amount to advance the valve-closing-completion timing when the valve-closing-completion timing becomes larger than a target value larger than the saturated-valve-closing timing stored in the saturated-valve-closing timing memory, and decreases the current application amount to delay the valve-closing-completion timing when the valve-closing-completion timing is equal to or less than the target value.

2. The control device for a high-pressure fuel pump according to claim 1, wherein the valve-closing-completion sensor includes a current measurement circuit that converts the current into a voltage and outputs a voltage signal, a differentiation circuit that differentiates the voltage signal, an absolute value circuit that obtains an absolute value of an output of the differentiation circuit, and a smoothing circuit that smooths an output of the absolute value circuit by a time constant longer than a cycle based on a switching frequency of the current, and a change point of an output of the smoothing circuit is detected as the valve-closing-completion timing.

3. The control device for a high-pressure fuel pump according to claim 1, wherein the valve-closing-completion sensor includes a current measurer, a filter that has a different gain with respect to a switching frequency of the current measured before and after the suction valve is shifted to the valve closing state, and an amplitude extractor, said extractor reads an amplitude of an output obtained from the filter to which the current is input, and detects a change point of the amplitude as the valve-closing-completion timing.

* * * * *